US008747257B2

(12) United States Patent
Hasegawa et al.

(10) Patent No.: US 8,747,257 B2
(45) Date of Patent: Jun. 10, 2014

(54) GOLF CLUB FITTING METHOD, DEVICE THEREOF, AND ANALYSIS METHOD

(75) Inventors: Hiroshi Hasegawa, Kobe (JP); Masahide Onuki, Kobe (JP)

(73) Assignee: SRI Sports Limited, Kobe (JP)

( * ) Notice: Subject to any disclaimer, the term of this patent is extended or adjusted under 35 U.S.C. 154(b) by 348 days.

(21) Appl. No.: 13/154,927

(22) Filed: Jun. 7, 2011

(65) Prior Publication Data

US 2011/0300959 A1 Dec. 8, 2011

(30) Foreign Application Priority Data

Jun. 8, 2010 (JP) ..... 2010-131267
May 30, 2011 (JP) ..... 2011-120217

(51) Int. Cl.
*A63B 53/00* (2006.01)

(52) U.S. Cl.
USPC ..... 473/409

(58) Field of Classification Search
USPC ..... 473/221, 223, 409
See application file for complete search history.

(56) References Cited

U.S. PATENT DOCUMENTS 5,821,417 A 10/1998 Naruo et al.
6,000,286 A 12/1999 Naruo et al.
6,003,368 A 12/1999 Naruo et al.
6,014,887 A 1/2000 Naruo et al.
6,041,651 A 3/2000 Naruo et al.
8,574,100 B2 * 11/2013 Hasegawa et al. ..... 473/409
2006/0111197 A1 5/2006 Yamamoto et al.
2011/0300959 A1 * 12/2011 Hasegawa et al. ..... 473/221
2012/0108363 A1 * 5/2012 Hasegawa et al. ..... 473/409
2013/0143685 A1 * 6/2013 Margoles et al. ..... 473/231
2013/0260909 A1 * 10/2013 Margoles et al. ..... 473/223
2013/0260923 A1 * 10/2013 OKAZAKI et al. ..... 473/409
2013/0288829 A1 * 10/2013 KIMIZUKA et al. ..... 473/409

* cited by examiner

*Primary Examiner* — Raleigh W Chiu
(74) *Attorney, Agent, or Firm* — Birch, Stewart, Kolasch & Birch, LLP

(57) ABSTRACT

The analysis method includes steps of acquiring measurement data obtained from swings and values of hitting results (flight distance or the like) (STEP 3); calculating a characteristic value (face angle or the like) from the measurement data (STEP 4); and determining an indicator for selecting a shaft of a golf club from the characteristic value and the values of hitting results (STEP 5). In the step of determining an indicator, when a hitting result of a golf club is an objective variable, and the characteristic value is an explanatory variable together with a predetermined shaft physical property (flex point or the like), and has a statistically significant relation with the hitting result, the characteristic value is determined as the indicator. A relational expression of the indicator and the hitting result is calculated for each value of the physical properties.

23 Claims, 18 Drawing Sheets

GOLF CLUB FITTING METHOD, DEVICE THEREOF, AND ANALYSIS METHOD

This application involves a claim for benefits based on Japanese Patent Application No. 2010-131267 filed on Jun. 8, 2010 and Japanese Patent Application No. 2011-120217 filed on May 30, 2011, which are incorporated herein by reference.

BACKGROUND OF THE INVENTION

1. Field of the Invention

The present invention relates to fitting of a golf club.

2. Description of the Related Art

Selection of a golf club which fits a golf player is referred to as fitting. A person who performs fitting of a golf club to a golf player is referred to as a fitter. Physical properties of a shaft of a golf club have a large affect on the fitting.

For example, one of the physical properties of a shaft is flex. The flex represents hardness of a shaft. In general, for the flex, fit hardness is recommended depending on whether head speed is fast or slow. To a golf player whose head speed is relatively slow, a flexible shaft is recommended. To a golf player whose head speed is relatively fast, a hard shaft is recommended. However, there is no uniform standard for the flex, and thus it is defined by a standard which differs depending on a manufacturer. Selection of a value of fit flex often relies on a fitter's experience and hunch.

An example of other physical properties of a shaft includes a flex point, torque, and weight. Also for a flex point, torque, and weight, selection a fit value cannot help but rely on a fitter's experience and hunch. Fitting by a fitter involves a variation due to the fitter's subjective view or the like. In such fitting, when a fitter differs, a golf club to be selected will differ.

Hence, it is proposed to measure swing of a golf player and perform fitting based on result of the measurement. For example, in Patent publication No. 3061640, timing of swing is measured. A fit shaft is recommended based on the measured timing. In Patent Publication No. 4184363, head speed and speed of a grip section before ball impact are measured. A fit shaft is recommended based on the head speed and the speed of the grip section. According to these methods, fitting can be performed in an objective manner.

SUMMARY OF THE INVENTION

However, in these methods, a relationship between a hitting result of a golf club and fitting remains undefined. Whether it is fitting based on the timing of swing or fitting based on the head speed and the speed of a grip section, a relation with a flight distance, a direction of flight, or the like has not been clarified. It is considered that the undefined relationship is one of reasons why no improvement is made in the flight distance, the direction of flight or the like, when fitting of a golf club has been performed.

An objective of the present invention is to provide a method for analysis which determines an indicator associated with a hitting result of a golf club. Another objective of the present invention is to provide a method for fitting a golf club and a fitting device using the indicator.

A method for fitting a golf club according to the present invention includes steps of:

preparing a relation C1 in which a face angle before or at ball impact and a hitting result are considered, wherein the face angle and the hitting result are measured when a plurality of golf players makes swings using a plurality of golf clubs with different values of shaft physical properties;

obtaining a measurement result of the face angle by a subject (golf player) hitting a ball with a test club; and determining a shaft physical property which fits the subject on the basis of the relation C1 and the measurement result of the face angle.

Preferably, the relation C1 is a relational expression F1.

Preferably, when a relational expression of the hitting result and the face angle is F11 and a relational expression of the face angle and the shaft physical properties is F12, the relational expression F1 is the relational expression F12 created by using the relational expression F11.

Preferably, the relational expression F12 is such a relational expression that the greater the measured face angle is, the lower a recommended shaft flex point is.

Preferably, a preferable hitting result at a standard shaft flex point Th is reflected in the relational expression F12.

Preferably, two or more types of hitting results are considered in the relational expression F12.

Preferably, the relational expression F12 is created by modifying a relational expression based on a first hitting result, on the basis of a second hitting result.

Preferably, the modification based on the second hitting result is such a modification that the second hitting result is preferable at the standard shaft flex point Th.

Preferably, the first hitting result is a direction of a hit ball, and the second hitting result is flight distance.

Preferably, in the relational expression F12, the measured face angle is a first input variable; a value showing a relation of a shaft flex point rate of the test club and the standard shaft flex point Th is a second input variable; and the shaft flex point rate which fits the subject is a result variable.

Preferably, in the fitting method, the shaft physical property is a shaft flex point. Preferably, the relational expression F11 and/or the relational expression F12 is a linear expression. Preferably, the hitting result in the relational expression F11 is right/left direction in which a ball flies.

A method for fitting a golf club according to the present invention includes the steps of: acquiring measurement data and hitting results of a plurality of golf players using a plurality of golf clubs with different values of shaft physical properties; obtaining characteristic values on the basis of the measurement data; determining an indicator for selecting a shaft of a golf club from the characteristic values and the hitting results; obtaining a relational expression F1 (relational expression F11) of the indicator and the hitting result for each value of the shaft physical properties; obtaining a measurement result corresponding to the indicator by a subject (golf player) hitting a ball with a test club; and determining a shaft physical property which fits the subject on the basis of the relational expression F1 and the measurement result. In the step of acquiring the multiple measurement data pieces and the hitting results, multiple measurement data pieces are obtained from swings of the golf player and hitting of the swings. In the step of determining the indicator, the characteristic value is determined as the indicator when the hitting result is an objective variable, the characteristic value and the value of the shaft physical property are explanatory variables, and the characteristic value has a statistically significant relation with the hitting result.

Preferably, in the step of determining an indicator, a plurality of indicators is determined. The method of fitting further includes steps of: calculating accuracy rates of values of shaft physical properties determined from the plurality of indicators; and selecting an indicator used in fitting of a golf club on the basis of the accuracy rate.

In the step of calculating accuracy rates of values of shaft physical properties, a value Xa of a fit shaft is selected based on a relational expression F1 (relational expression F11) of the indicator and the hitting result. A value Xb of a fit shaft is determined based on a value of a hitting result to be obtained from the swings. A golf player rate for which the value Xa and the value Xb match is calculated, and the rate is the accuracy rate.

In the step of selecting an indicator used in fitting of a golf club, an indicator with the highest accuracy rate is selected as the indicator used in fitting.

Preferably, in the method for fitting, the hitting result is a flight distance of a ball. The shaft physical property is a shaft flex point. The characteristic value is a face angle before or at ball impact.

Preferably, in the method for fitting, the hitting result is a right/left direction in which a ball flies. The shaft physical property is a shaft flex point. The characteristic value is a face angle before or at ball impact.

Preferably, in the method for fitting, a value X of a face angle at which an absolute value of a direction in which a ball flies is 0 is determined, for a value Y of each of the shaft flex point. An approximate expression which satisfies a relation of a value Y of the each flex point of the plurality of shafts and a value X of the face angle is determined. Preferably, the approximate expression is the relational expression F1 (relational expression F12).

$Y=A1\cdot X+B$ (Coefficient $A1$ and intercept $B$ are a constant.)

Preferably, in the method for fitting, the intercept B is modified based on the relation of the flight distance of a ball and a value of the face angle.

A golf club fitting device according to the present invention includes an image shooting section or a sensor which acquires measurement data from swings of a subject (golf player) and hitting of the swings, and a calculating section. The calculating section determines a fit shaft physical property on the basis of an indicator obtained from the measurement data. In the determination of the shaft physical property, the characteristic value is an indicator when a hitting result of the golf club is an objective variable, a characteristic value obtained from the measurement data and a value of the shaft physical property are explanatory variables, and the characteristic value has a statistically significant relation with the hitting result. A relational expression F1 (relational expression F11) of the indicator and the hitting result is calculated for each shaft physical property. The hitting result is determined from the indicator and the relational expression F1 (relational expression F11), and a shaft physical property with the best hitting result is determined as a fit shaft physical property.

A method for analyzing swing of a golf club according to the present invention includes the steps of: acquiring measurement data and hitting results of a plurality of golf players using a plurality of golf clubs with different values of shaft physical properties; obtaining characteristic values on the basis of the measurement data; determining an indicator for selecting a shaft of a golf club from the characteristic values and the hitting results; and obtaining a relational expression F1 (relational expression F11) of the indicator and the hitting results for each value of the shaft physical properties. In the step of acquiring the multiple measurement data pieces and hitting results, multiple measurement data pieces are obtained from swings of golf players and hitting of the swings. In the step of determining the indicator, the characteristic value is determined as the indicator, when the hitting result is an objective variable, the characteristic value and the value of the shaft physical property are explanatory variables, and the characteristic value has a statistically significant relation with the hitting result.

Preferably, in the step of determining the indicator of the method for analysis, a plurality of indicators is determined. The method for analysis includes steps of: calculating an accuracy rate of values of shaft physical properties determined from the plurality of indicators; and selecting an indicator used in fitting of a golf club. In the step of calculating the accuracy rate of values of shaft physical properties, a value Xa of a fit shaft is selected based on a relational expression F1 (relational expression F11) of the indicator and the hitting result. A value Xb of a fit shaft is determined based on a value of a hitting result to be obtained from the swings. A golf player rate for which the value Xa and the value Xb match is calculated. This rate is an accuracy rate. In the step of selecting an indicator used in fitting of a golf club, an indicator with the highest accuracy rate is selected as the indicator used in fitting.

Preferably, in the method for analysis, the hitting result is a flight distance of a ball. The shaft physical property is a shaft flex point. The characteristic value is a face angle before or at ball impact.

Preferably, in the method for analysis, the hitting result is a right or left direction in which a ball flies. The shaft physical property is a shaft flex point. The characteristic value is a face angle before or at ball impact.

With the method for analysis according to the present invention, a fit indicator can be identified to improve a hitting result. With the fitting method or device according to the present invention, a golf club which can improve a hitting result can be appropriately fitted by the indicator.

DESCRIPTION OF THE PREFERRED EMBODIMENTS

In this application, a concept of relation C1, relation C11, and relation C12 is used. In addition, in the application, a concept of a relational expression F1, a relational expression F11, and a relational expression F12 is used.

The relation C1 is a relation which considers an indicator and a hitting result. A preferable relation C1 is a relation which considers a face angle and a hitting result. The relation C1 may be or may not be an expression.

The relation C11 is a subordinate concept of the relation C1. The relation C11 is a relation of a hitting result and an indicator. Preferably, the relation C11 is a relation of the hitting result and the face angle. The relation C11 may be or may not be an expression.

The relation C12 is a subordinate concept of the relation C1. The relation C12 is a relation of shaft physical properties and an indicator. Preferably, the relation C12 is a relation of the shaft physical properties and a face angle. The relational expression C12 may be or may not be an expression.

The relational expression F1 is a subordinate concept of the relation C1. Of the relation C1, relation limited to an "expression" is a relational expression F1.

The relational expression F11 is a subordinate concept of the relational expression F1. The relational expression F11 is a relational expression of a hitting result and an indicator. Preferably, the relational expression F11 is a relational expression of a hitting result and a face angle.

The relational expression F11 is a subordinate concept of the relation C11.

The relational expression F12 is a subordinate concept of the relation F1. The relational expression F12 is a relational expression of shaft physical properties and an indicator. Preferably, the relational expression F12 is a relational expression of shaft physical properties and a face angle.

The relational expression F12 is a subordinate concept of the relation C12.

The present invention will be described in detail hereinafter based on preferred embodiments, and with reference to the drawings, as appropriate.

Figure 1:
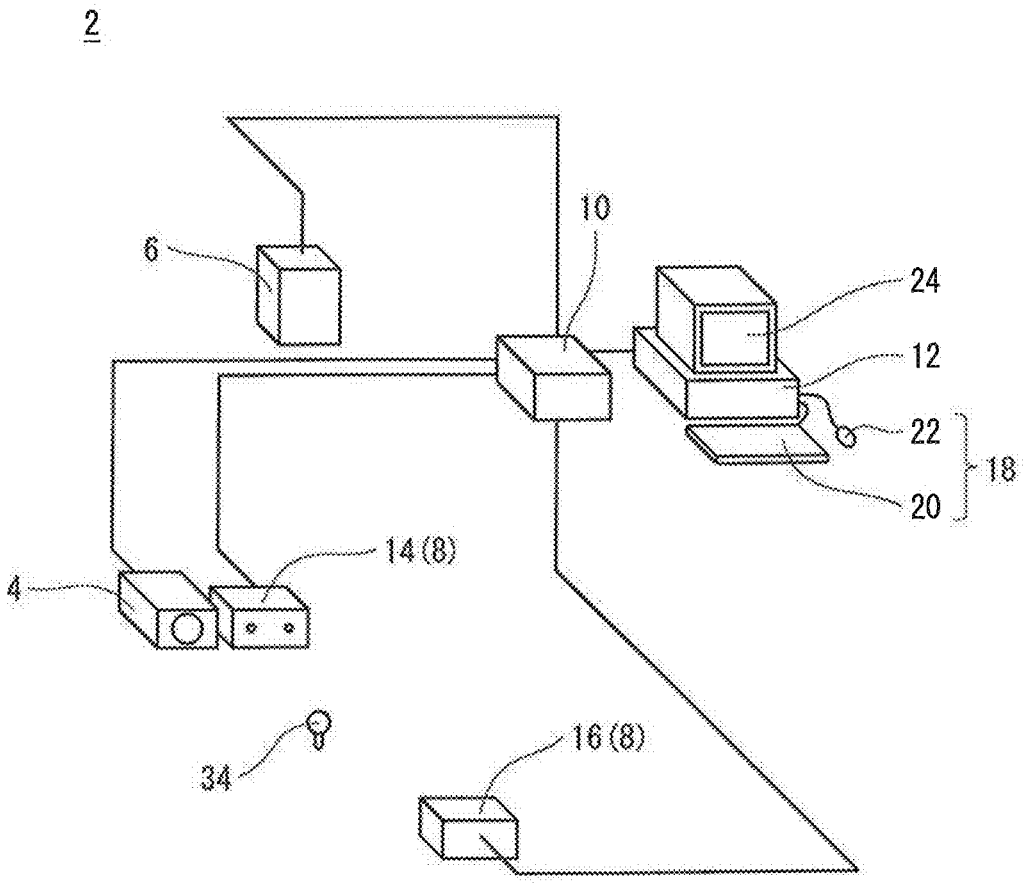
FIG. 1 is a schematic view showing a configuration of a fitting device of an embodiment according to the present invention.

FIG. 1 shows a fitting device 2 of a golf club used for a right-handed golf player, as an example. The fitting device 2 includes a front face camera 4 and an upper camera 6 as an image shooting section, a sensor 8, a controller 10, and an information processor 12 as a calculating section. The sensor 8 includes a light emitter 14 and a light receiver 16.

The front face camera 4 is located at a front face of a golf player who swings. The front face camera 4 is positioned at a position and an orientation which allows shooting of a swing image from the front face of the golf player. The upper camera 6 is located above a position where a ball 34 is placed. The upper camera 6 is positioned at a position and an orientation which allows shooting of a swing image from above the golf player. Examples of the front face camera 4 and the upper camera 6 include a CCD camera. The front face camera 4 and the upper camera 6 are exemplification. A camera which can shoot from the front, a camera which can shoot from the back, or the like may be further included. A camera which can shoot from the front or the back may be included in place of the front face camera 4 or the upper camera 6.

The light emitter 14 of the sensor 8 is located in front of a swinging golf player. The light receiver 16 is located at the foot of the swinging golf player. The light emitter 14 and the light receiver 16 are positioned at a position through which a swung golf club passes. The sensor 8 can detect a head or a shaft of the passing golf club. The sensor 8 may be located at a position where it can detect the head or the shaft, and positioned in the front or the back. The sensor 8 is not limited to one provided with the light emitter 14 and the light receive 16. The sensor 8 may be of reflection type.

The controller 10 is connected to the front face camera 4, the upper camera 6, the sensor 8, and the information processor 12. The controller 10 can send a shooting start signal and a shooting stop signal to the front face camera 4 and the upper camera 6. The controller 10 can receive a signal of a swing image from the front face camera 4 and the upper camera 6. The controller 10 can receive a detection signal of the head or the shaft from the sensor 8. The controller 10 can output a signal of a swing image and a detection signal of the head or the shaft to the information processor 12.

Figure 2:
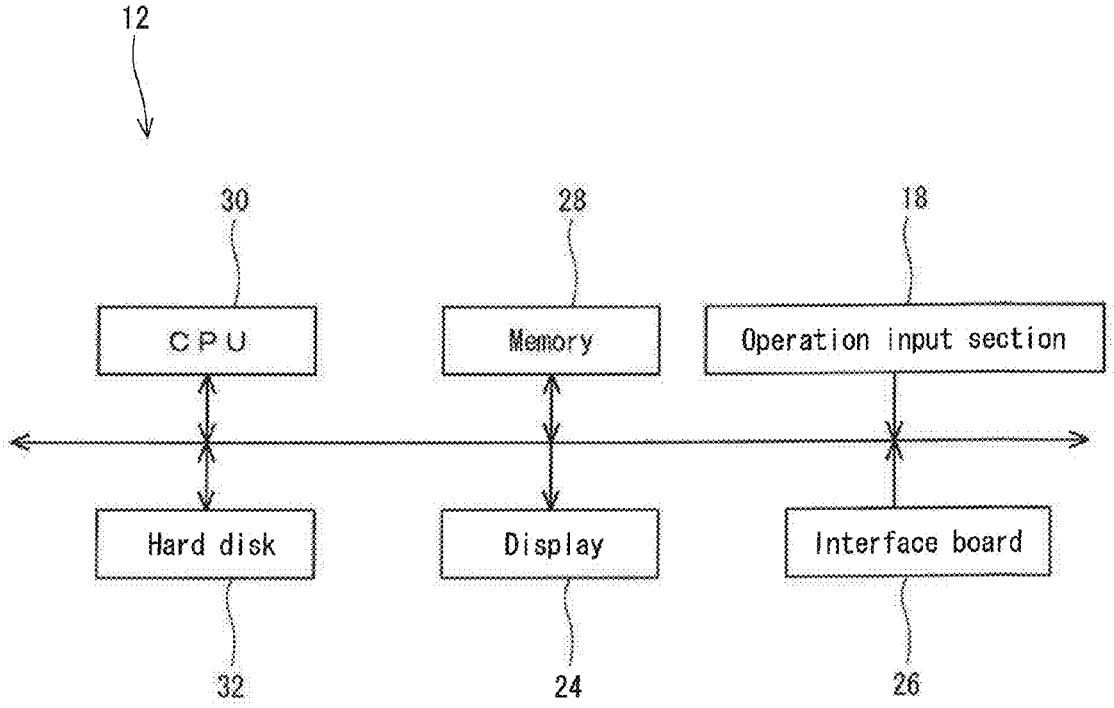
FIG. 2 is an illustration showing a system configuration of an information processing device which constitutes the fitting device of FIG. 1.

As shown in FIG. 1 and FIG. 2, the information processor 12 includes a keyboard 20 and a mouse 22 as an information input section 18, a display 24 as an output section, an interface board 26 as a data input section, a memory 28, a CPU 30, and a hard disk 32. For the information processor 12, a general-purpose computer may be used as it is.

The display 24 is controlled by the CPU 30. The display 24 displays various types of information. The output section may be one which displays fitting information such as a fitted shaft, measurement data of a golf club or swing, or the like. The output section is not limited to the display 24, and a printer may be used, for example.

A signal of a swing image or a detection signal of the head or the shaft, or the like is inputted into the interface board 26. Measurement data is obtained from the image signal or the detection signal. The measurement data is outputted to the CPU 30.

The memory 28 is a rewritable memory. The hard disk 32 stores a program, data, or the like. For example, values of a plurality of shaft physical properties are stored as a database. To be specific, data or expressions or the like which show a relation of an indicator and a hitting result for each value of the physical properties are stored. The memory 28 constitutes a storage area or working area or the like for programs or measurement data read from the hard disk 32.

The CPU 30 can read a program stored in the hard disk 32. The CPU 30 can expand such a program into the working area of the memory 28. The CPU 30 can execute various processes according to the program.

Figure 3:
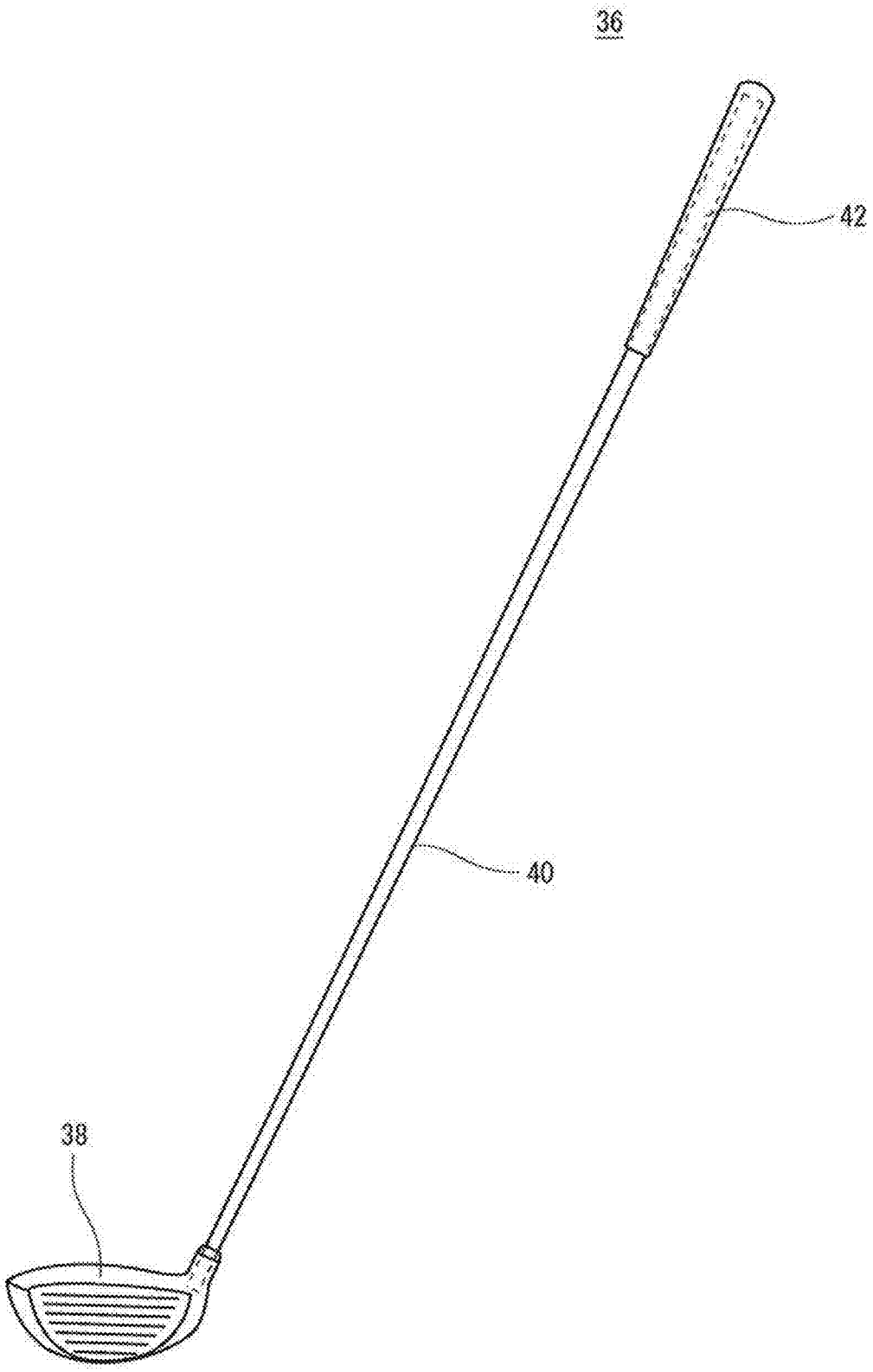
FIG. 3 is a front view of a golf club used in the fitting device of FIG. 1.

A golf club 36 shown in FIG. 3 is an example of a golf club used in the fitting device 2. A golf club used in a fitting method, which is to be described later, is referred to as a test club. The golf club 36 is an example of a test club. The golf club 36 includes a head 38, a shaft 40, and a grip 42.

Figure 4A:
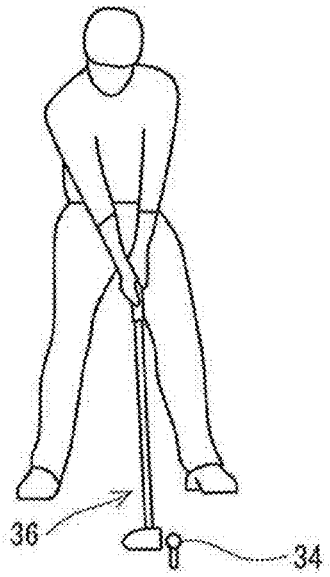
FIG. 4A to 4D are illustrations of a swing position.
Figure 4B:
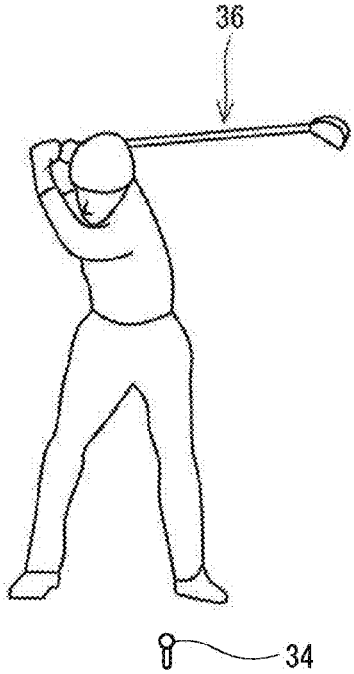
Figure 4C:
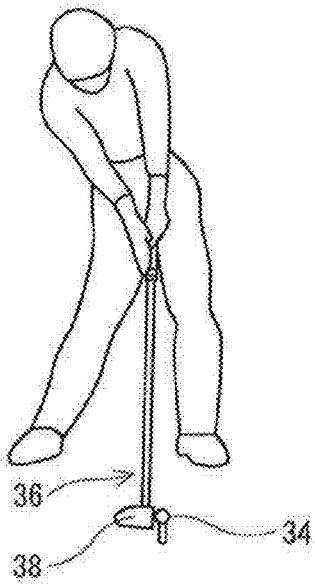
Figure 4D:
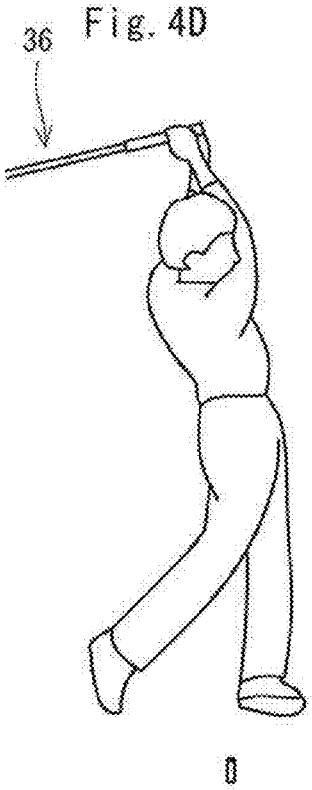

FIG. 4A to 4D show respective positions where a golf player swings the golf club 36. A position in FIG. 4A shows an address. A position in FIG. 4B shows a top of swing (hereinafter referred to as a top). A position in FIG. 4C shows an impact. An impact is a position at the moment when the head 38 and the ball 34 collide. A position in FIG. 4D shows a finish. Swing of a golf player successively shifts from the address to the top, from the top to the impact, and from the impact to the finish. The swing finishes at the finish.

Figure 5:
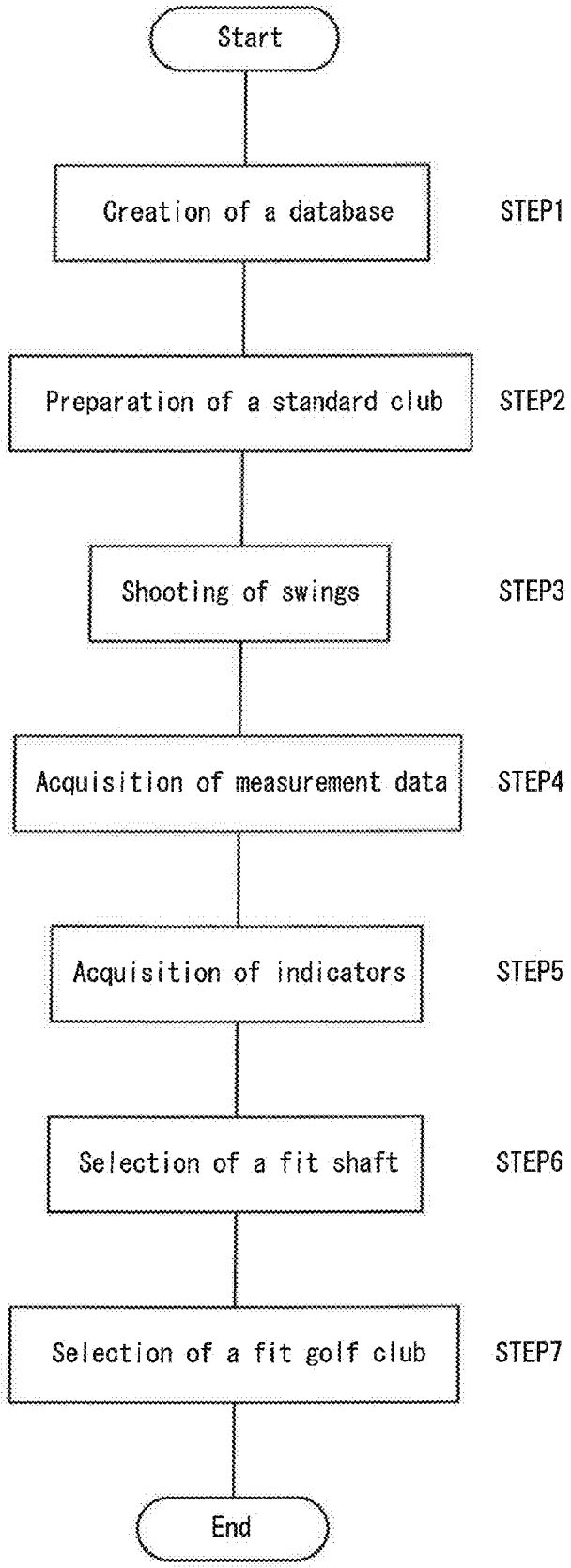
FIG. 5 is a flow chart showing an example of a fitting method according to the present invention.

FIG. 5 shows an example of a procedure of a golf club fitting method according to the present invention. The hitting result includes flight distance of a ball and a right/left and up/down direction in which a ball flies. With reference to FIG. 5, a description will be given by illustrating the flight distance of the ball 34 as an example of a hitting result. A description will be given by illustrating a shaft flex point as an example of a shaft physical property. A value of the shaft flex point is a low flex point, a middle flex point, and a high flex point. A description will be given by illustrating a face angle before or at impact as a characteristic value which is an indicator. The before impact refers to time when a centerline of a tee and a face surface of the head 38 are at a predetermined distance which has been defined in advance. In this example, the before impact refers to time when a distance between the centerline of the tee and the face surface of the head 38 is 3 cm. If no tee is used, a vertical line passing through a center of the ball 34 may be used in place of the centerline of the tee. Preferably, the before impact refers to time when a distance between a vertical line passing through a center of a ball and a face surface is within 10 cm, and more preferably, within 5 cm.

A face angle is preferably an orientation of a face at a hitting point. If a bulge has been added to a face, an orientation of the face is determined from a tangent line at a hitting point. Although a hitting point has not been determined before impact, it is possible to predict a hitting point on the basis of a path of a head or the like.

If an image at impact can be obtained, a face angle can be measured from the image. However, it may be difficult to obtain an image at impact. From a standpoint of ease of measurement, it is preferable that a face angle before impact is measured.

A face angle is measured based on an image of a face surface. However, an image of a marker provided on a crown may be used in place of an image of a face surface. For example, the marker is a line along a borderline between a crown and a face surface. Other example is the marker is two or more points along a borderline between a crown and a face surface. In an image shot from above with a camera, a face angle can be calculated based on the image of the marker mentioned above.

In the information processor 12 of FIG. 1, a database of values of shaft flex points, flight distances, and face angles before impact is created. Data in the database is obtained by an analysis method to be described later. This is a database creation step (STEP 1). Information which identifies the head 38 and the shaft 40 has been inputted into the information processor 12. The information identifying the head 38 and the shaft 40 may be inputted from the keyboard 20 during fitting. The information identifying the head 38 or the shaft 40 may be selected with the mouse 22 from multiple pieces of information displayed on the display 24.

The golf club 36 of FIG. 3 will be prepared. This is a test club preparation step (STEP 2). A value of a flex point of the shaft 40 of the golf club 36 is a middle flex point, for example. The golf club to be prepared may be equipped with a shaft with a value of any flex point. A value of the flex point of the shaft may be a high flex point or a low flex point.

An image of a golf player's swing will be shot. This is a swing shooting step (STEP 3). A golf player takes an address position in the fitting device 2. The golf player makes a swing. The golf player hits the ball 34 with the golf club 36. When the golf player shifts from top to impact, the sensor 8 detects the head 38 or the shaft 40. The detection signal is outputted to the controller 10.

The controller 10 outputs the detection signal and a swing image signal to the information processor 12. The information processor 12 acquires measurement data from these signals. This is a measurement data acquisition step (STEP 4).

In this step (STEP 4), multiple swing image signals may be extracted. Each of the multiple swing image signals may be converted into measurement data. The information processor 12 may determine measurement data to be used in fitting from multiple measurement data pieces, using the information identifying the image.

The information processor 12 calculates a value of the face angle from the measurement data. This is an indicator acquisition step (STEP 5). A method for determining the indicator will be described later. In the fitting method, the step of obtaining a measurement result of a face angle by a subject (golf player) hitting a ball with a test club consists of the (STEP 2) to (STEP 5).

The indicator includes in addition to a face angle before or at impact, speed of the ball 34, a spin rate (spin amount) of the ball 34, a spin orientation of the ball 34, an initial-launch angle of the ball 34 in up/down and right/left directions, hitting positions in up/down and toe/heel directions, head speed of a golf club, an incident angle of the head 38, a blow angle of the head 38, a loft angle, a swing plane angle of a golf player, a shoulder twist angle, and a swing direction travel distance. An indicator may be obtained from measurement data of movement of the ball 34 and swing motion of a golf player or the like. The measurement data may also be obtained from a signal of the sensor.

The information processor 12 selects a fit shaft. This is a fit shaft selection step (STEP 6). To be specific, a relation of a flight distance of the ball 34, values of shaft flex points, and a face angle is determined. Based on the relation, for each value of the shaft flex points, a relational expression F1 (relational expression F11) of the flight distance and the face angle is stored. This is an example of a step of obtaining a relational expression F1 (relational expression F11) of a face angle before ball impact and a hitting result when a golf player swings by using a plurality of golf clubs with different values of shaft physical properties.

Based on the relational expression F1 (relational expression F11), a value of shaft flex point at which the flight distance is largest is determined from a value of the face angle obtained from the golf player. The value of the shaft flex point is a value of the fit shaft physical property. In the fitting method, a step of determining a shaft physical property which fits a subject on the basis of the relational expression F1 (relational expression F11) and a measurement result of the face angle is this (STEP 6). The selection of the shaft is performed based on a value of the fit shaft physical property. The shaft physical property includes, in addition to a shaft flex point, flex, torque, or weight.

The information processor 12 selects a golf club having the shaft on the basis of the value of the shaft physical property. This is a fit golf club selection step (STEP 7). The display 24 displays fitting information such as identifying the golf player, fitting information and a face angle as an indicator value and a fit golf club. Although the information is not shown, it may also be printed by a printer as the output section.

Furthermore, the best fit shaft physical property may be determined based on a shaft flex point determined in the (STEP 6). A plurality of golf clubs with shafts close to a value of the flex point which is determined fit and having values of flex points which differ from each other will be prepared. A subject makes attempts to hit with the golf clubs with the shafts having different flex points. From the attempts, a value of the flex point with the best hitting result may be determined as a value of the best fit flex point.

In addition, a plurality of golf clubs with shafts having the value of the flex point which is determined fit and other shaft properties (flex, torque, or weight) which differ from each other may also be prepared. A subject makes attempts to hit with the golf clubs. From the attempts, a shaft (golf club) with the best hitting result may be determined as the best fit shaft (golf club).

In the embodiment, a shaft physical property which fits a subject is determined by using a relation of flight distance of the ball 34 and a face angle before impact. The relational expression F1 is a relational expression F11 of a face angle before impact and flight distance.

As an example of a hitting result of the fitting method, a description will be given by illustrating right and left directions in which the ball 34 flies (hereinafter simply referred to as a right/left deflection). Now, a configuration which differs from the fitting method described above will be mainly described. For any similar configuration, a description thereof will be omitted.

The right/left deflection is shown as an angle. When a ball is driven out straight, the right/left deflection is an angle of 0 degree. If the ball is driven out, deflecting to the left direction, a minus value is displayed, showing magnitude of the deflection in degrees. If the ball is driven out, deflecting to the right, a plus value is displayed, showing magnitude of the deflection in degrees.

In the information processor 12 of FIG. 1, a database of values of shaft flex points, a right/left deflection, and face angles before impact is created. This is a database creation step (STEP P1). Information which identifies the head 38 and the shaft 40 has been inputted into the information processor 12.

The golf club 36 of FIG. 3 will be prepared. This is a test club preparation step (STEP 2). An image of a golf player's swing will be shot. This is a swing shooting step (STEP 3). The controller 10 outputs the detection signal and a swing image signal to the information processor 12. The information processor 12 acquires measurement data from these signals. This is a measurement data acquisition step (STEP 4). The information processor 12 calculates a value of the face angle from the measurement data. This is an indicator acquisition step (STEP 5).

The information processor 12 selects a fit shaft. This is a fit shaft selection step (STEP 6). To be specific, a relation of a right/left deflection of the ball 34, values of shaft flex points, and a face angle is determined by an analysis method to be described later. Based on the relation, for each value of the shaft flex points, a relational expression F1 (relational expression F11) of the right/left deflection and the face angle is stored. Based on the relational expression F1 (relational expression F11), a value of a shaft flex point at which a right/left deflection is smallest is determined from a value of the face angle obtained from the golf player. The value of the shaft flex point is a value of the fit shaft physical property.

The information processor 12 selects a golf club with the shaft on the basis of the value of the shaft physical property. This is a fit golf club selection step (STEP 7). The display 24 displays fitting information such as identifying the golf player, a face angle as an indicator value and a fit golf club.

In the embodiment, a shaft physical property which fits a subject is determined by using a relation of a right/left direction in which the ball 34 flies and a face angle before impact. The above-mentioned relational expression F1 (relational expression F11) is a relational expression of a face angle before impact and a right/left direction in which the ball 34 flies.

Figure 6:
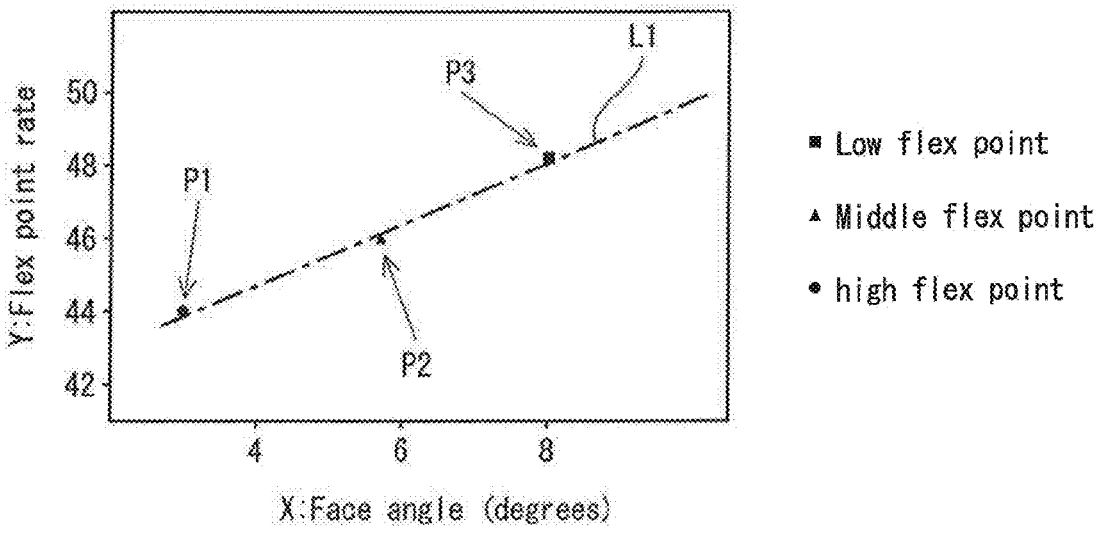
FIG. 6 is a graph showing a relation of a flex point and a face angle when a deflection between right and left is small.

In addition, FIG. 6 shows other example of the fit shaft selection step (STEP 6). A straight line L1 of FIG. 6 shows other relational expression F1 (relational expression F12) of a face angle X and a flex point rate Y as a value of a flex point when the right/left deflection is smallest (right/left direction is 0 degree). A method for determining the relational expression F1 will be described later. The relational expression F1 (relational expression F12) will be expressed by the following expression:

$Y=A1\cdot X+B$ (Coefficient $A1$ and intercept $B$ are a constant.)

As a value of the face angle a face angle which was obtained from the golf player is provided. A value Y of a flex point is calculated. Among values of shaft flex points, a value which is closest to the calculated value Y of the flex point is selected. Based on the value of the flex point, a shaft is selected. In addition, based on the value of the flex point, the shaft may be custom-made.

The relational expression F1 (relational expression F12) is based on a face angle which was determined by using a test club with an analysis method to be described later. There are some cases in which a subject is subjected to fitting with a golf club which is different from the test club. There are some cases in which a value of a shaft flex point of a golf club used in fitting differs from a value of a flex point of a test club.

If a face angle X when a subject uses a test club (with a shaft flex point rate D1) is Xd1, a flex point rate Y to be recommended to the subject is determined from the relational expression F1 (relational expression F12).

$$Y=A1\cdot Xd1+B$$

However, if it is changed to a flex point rate D2 of a golf club used in fitting, a value of the face angle to be measured will also change to Xd2. The above-mentioned relational expression F1 (relational expression F12) will be:

$$Y'=A1\cdot Xd2+B$$

The flex point rate Y' differs from the flex point rate Y which is essentially recommended.

Then, correction is made so that the flex point rate Y' equals to the flex point rate Y. The corrected relational expression F1 (relational expression F12) is expressed by the following expression:

$$Y=A1\cdot X+B+(D2-D1)$$

The correction of the relational expression F1 (relational expression F12) enables a recommended flex point rate to be determined by using the relational expression F1 (relational expression F12) even though a golf club different from a test club is used.

In addition, a multiple regression equation may be used as a relational expression F1 (relational expression F11) of a face angle and a hitting result. In the multiple regression equation, one objective variable is expressed by a plurality of explanatory variables. A multiple regression analysis reflects to what extent which explanatory variable influences an objective variable. Since the multiple regression equation considers a plurality of explanatory variables, precision of fitting can improve. The multiple regression equation is not limited, and example of the multiple regression equation includes a linear expression, a quadratic expression.

For example, the following multiple regression equation further as other relational expression F1 (relational expression F11) is obtained from a flight distance ratio Y1 as a hitting result, a face angle X1 as an indicator, and a flex point value X2 as a value of a shaft physical property:

$$Y1=A2\cdot X1+A3\cdot X2+A4\cdot X1\cdot X2+B1$$

(Coefficients A2, A3, A4 and intercept B1 are a constant.)

The relational expression F1 (relational expression F11) is determined from a relation of face angles before ball impact and flight distances when a plurality of golf players swing using a plurality of golf clubs having different shaft flex points. For example, values of the shaft flex points are a high flex point, a middle flex point, and a low flex point.

The flight distance ratio Y1 is determined based on flight distance L at a middle flex point shaft, for example. The flight distance ratio Y1 of the middle flex point is L/L and 1. The flight distance ratio Y1 of flight distance La at a low flex point shaft is determined as La/L. The flight distance ratio Y1 of flight distance Lb at a high flex point shaft is determined as Lb/L. Coefficients A2, A3, A4 and an intercept B1 are determined from a relation of a shaft flex point, a face angle, and flight distance (flight distance ratio). In addition, in the present invention, "flight distance" is a concept which contains a "flight distance ratio".

A subject hits a ball with a golf club with a shaft of a middle flex point, as a test club, and then a measurement result of a face angle is obtained. Based on the relational expression F1 (relational expression F11) and the measurement result, a flight distance ratios Y1 of the three types of shaft flex points is determined. A value at which the flight distance ratio Y1 is largest is considered as a shaft physical property which fits the subject.

Figure 7:
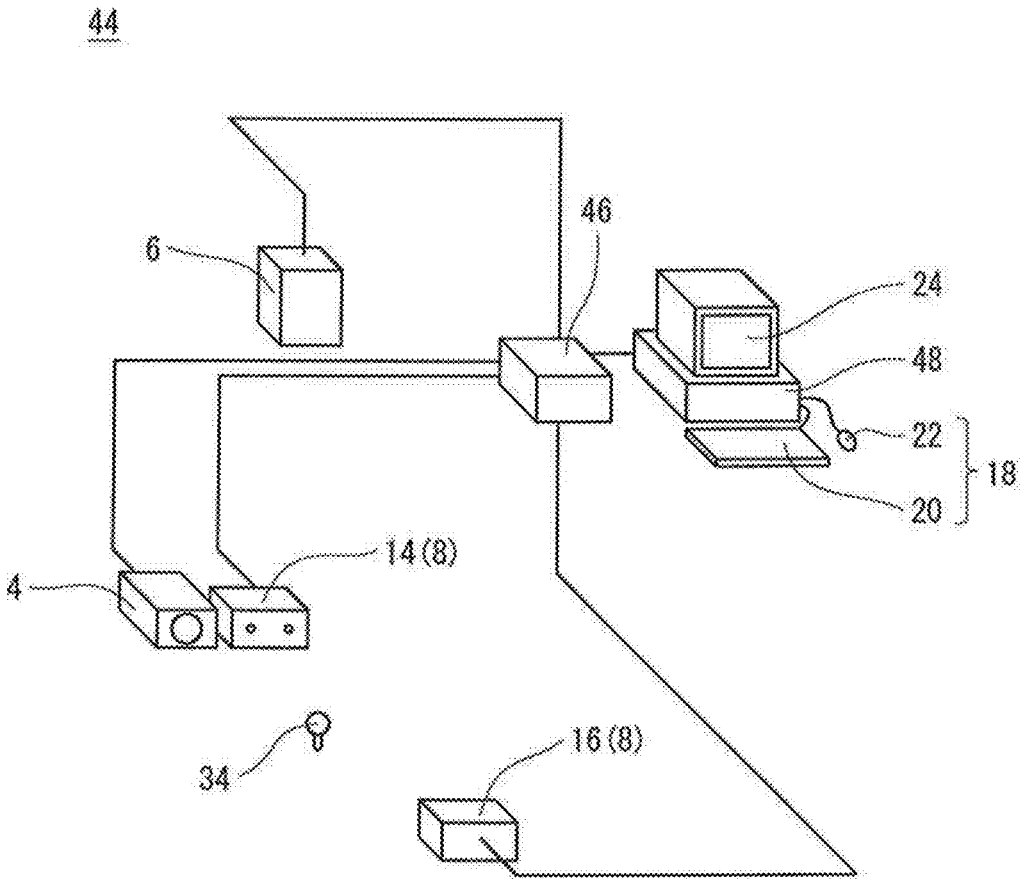
FIG. 7 is a schematic view showing a configuration of a swing analyzer of an embodiment according to the present invention.

FIG. 7 shows a swing analyzer 44. The swing analyzer 44 includes a front face camera 4, an upper camera 6, a sensor 8, a controller 46, and an information processor 48 as a calculating section. The front face camera 4, the upper camera 6, and the sensor 8 are same as the fitting device 2, and thus a description thereof will be omitted.

Similar to the controller 10, the controller 46 controls the front camera 4 and the upper camera 6. Similar to the controller 10, the controller 46 receives a detection signal of a head 38 or a shaft 40 from the sensor 8. The controller 10 may be used as this controller 46.

Similar to the information processor 12, the information processor 48 includes a keyboard 20 and a mouse 22 as an information input section 18, a display 24 as an output section, an interface board 26 as a data input section, a memory 28, a CPU 30, and a hard disk 32. A general-purpose computer may be used as the information processor 48 as it is. The information processor 12 may be used as the information processor 48.

Figure 8:
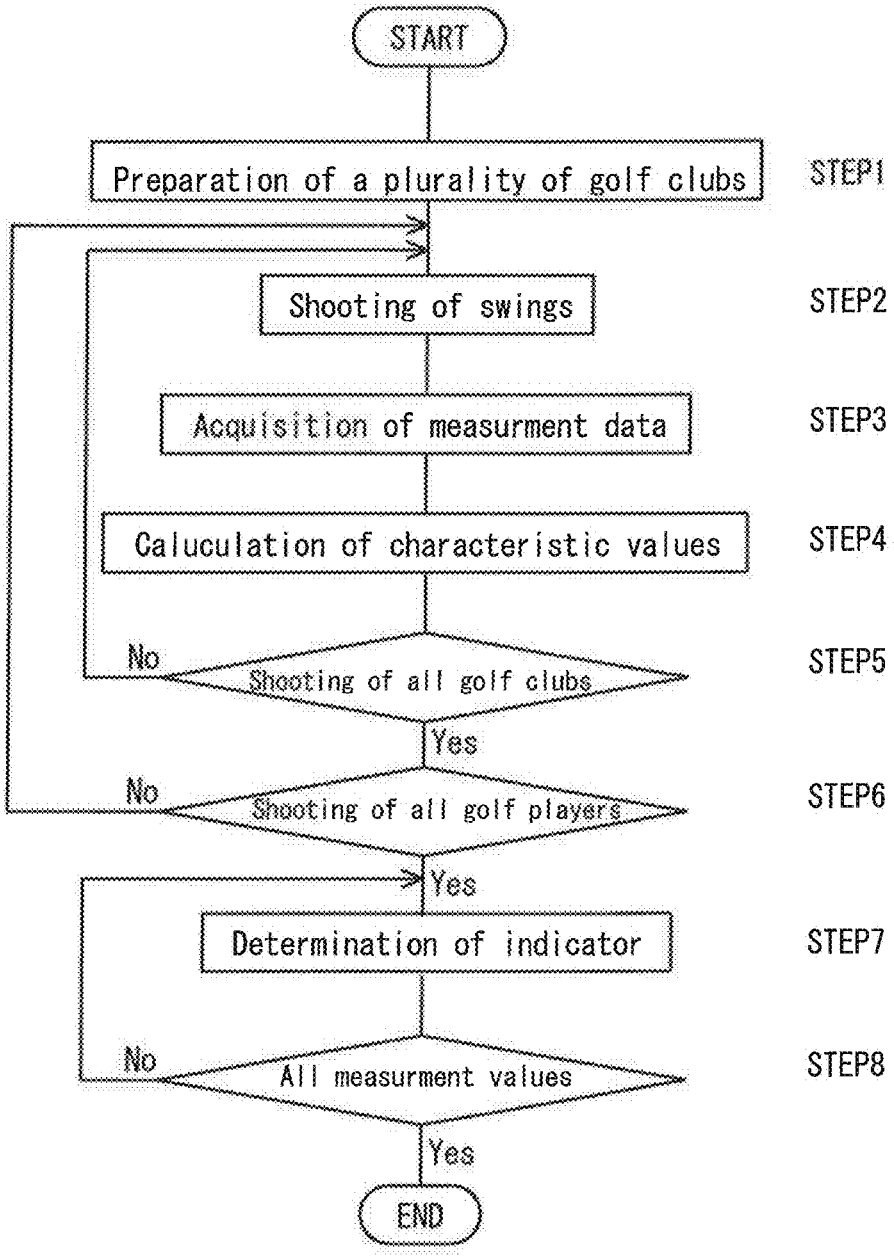
FIG. 8 is a flow chart showing an example of a method for analysis according to the present invention.

FIG. 8 shows a procedure of an example of a method for analyzing fitting of a golf club according to the present invention. In the analysis method here, with a flight distance of a ball 34 as a hitting result, an indicator for determining a value of a fit shaft flex point is obtained.

A plurality of golf clubs with different values of shaft flex points is prepared (STEP 1). To be specific, a golf club 36 in which a head 38 is attached to a shaft 40 of a middle flex point, a golf club A in which a head 38 is attached to a shaft of a low flex point, and a golf club B in which a head 38 is attached to a shaft of a high flex point are prepared. Here, although three types of golf clubs are prepared, the number of types of golf clubs may be 2 types, 4 types, or 5 types. The number of types of golf clubs may be plural, such as 2 or more types.

Images of golf player's swinging with a plurality of golf clubs are shot. This is a swing shooting step (STEP 2). Flight distance of a ball 34 of the swing is measured.

The controller 46 outputs image signals of the swings to the information processor 48. The information processor 48 acquires measurement data based on the image signals. Data on the flight distance of the ball 34 is inputted into the information processor 48 with the operation input section 18 such as the keyboard 20. The information processor 48 stores flight distance data of the ball 34 which corresponds to the measurement data. This is a measurement data acquisition step (STEP 3).

The information processor 48 calculates a characteristic value from the stored measurement data (STEP 4). A characteristic data is associated with each measurement data and stored. The characteristic value includes a face angle before impact, speed of the ball 34, a spin rate of the ball 34, a spin orientation of the ball 34, initial-launch angle of the ball 34 in up/down and right/left directions, hitting position in top/bottom and toe/heel directions, head speed of a golf club, an incident angle of the head 38, a blow angle of the head 38, a face angle before impact, a loft angle, a swing plane angle of a golf player, a shoulder twist angle, or a swing direction travel distance.

A golf player makes N swings (N is a natural number equal to or greater than 1). The golf player hits the ball 34 with the golf club 36 for N times. Images of the N swings with the golf club 36 are shot. A characteristic value obtained from the images of the N swings is determined. Here, the golf club 36 is a test club. The characteristic value is calculated from measurement data acquired with the golf club 36. For example, the characteristic value is calculated from an average of measurement data obtained from the measurement data of N times. For each golf player, flight distance is determined as an average of flight distance of N times with the golf club 36.

The process of (STEP 2) to (STEP 4) is repeated with the golf club A and the golf club B, in a similar manner (STEP 5). In addition, the process of (STEP 2) to (STEP 5) is repeated with a plurality of golf players (STEP 6). Thus, measurement data and characteristic values are obtained from swing images of the plurality of golf player. The swinging golf players are high-level golf players who repeatedly make almost constant swings.

The information processor 48 stores values of flex points, characteristic values, and flight distance of the ball 34 in a database. The information processor 48 extracts any characteristic value from the stored characteristic values.

The information processor 48 judges whether they have a statistically significant relation when the characteristic values and values of shaft physical properties are explanatory variables and flight distance of the ball 34 is made an objective variable. If so, the characteristic value are determined as one of indicators (STEP 7).

For example, the extracted characteristic value is a face angle before impact when a golf player swings with the golf club 36, and a value of a shaft physical property is a low flex point, a middle flex point, and a high flex point. Then, with a flight distance ratio Y1, a face angle mean X1, and a physical property value X2, a function is found by a multiple regression analysis, further as an example of other relational expression F1 (relational expression F11). The following relational expression is determined by the method of least squares:

$$Y1=A2\cdot X1+A3\cdot X2+A4\cdot X1\cdot X2+B1$$

(Coefficients A2, A3, A4 and an intercept B1 are a constant.)

Now, a flight distance ratio Y1 of each golf club to flight distance L of the golf club 36 is determined. The flight distance ratio Y1 of the golf club 36 is 1. The flight distance ratio Y1 of flight distance La at the golf club A is determined as La/L. The flight distance ratio Y1 of flight distance Lb at the golf club B is determined as Lb/L. The flight distance ratio Y1 is a vertical axis. This controls any effect of a difference in the flight distance due to an individual variation.

The face angle which is judged to have a statistically significant relation from the relational expression F1 (relational expression F11) is determined as one of indicators. The indicator is stored in the information processor 12. It is judged in a similar manner that whether all of the characteristic values determined in (STEP 4) falls under indicators (STEP 8). A plurality of indicators is thus determined. The plurality of indicators is stored in the information processor 12.

The relational expression F1 (relational expression F11) determined by the multiple regression analysis may also be determined as a linear expression, as shown below:

$$Y1=A5\cdot X1+A6\cdot X2+B2$$

(Coefficients A5, A6 and an intercept B2 are a constant.)

Any indicator can be selected from the plurality of indicators. Fitting of a golf club can be performed with the selected indicators. Fitting of a golf club may also be performed by combining a plurality of indicators from these indicators.

Through the use of a characteristic value having a significant relation, the fitting method can achieve fitting which improves a hitting result. By using this indicator, the fitting device 2 can achieve fitting which easily improves a hitting result. In the fitting method and the fitting device 2, fitting of a golf club is performed in an objective manner.

In the fitting method and the fitting device 2, fitting is performed with a plurality of shafts having different values of a predetermined physical property. Values of the physical property have been defined in advance and measured by a predetermined method. The fitting method is not affected by standards which differ for each manufacturer.

Now, the specified head 38 is used. With this, fitting for a golf player is performed with a combination of the head 38 and the shaft. The analysis method according to the present invention is also applicable to any other type of head. The fitting method which uses the indicator can perform fitting of a combination with the best fit shaft for an any specified head.

Figure 9:
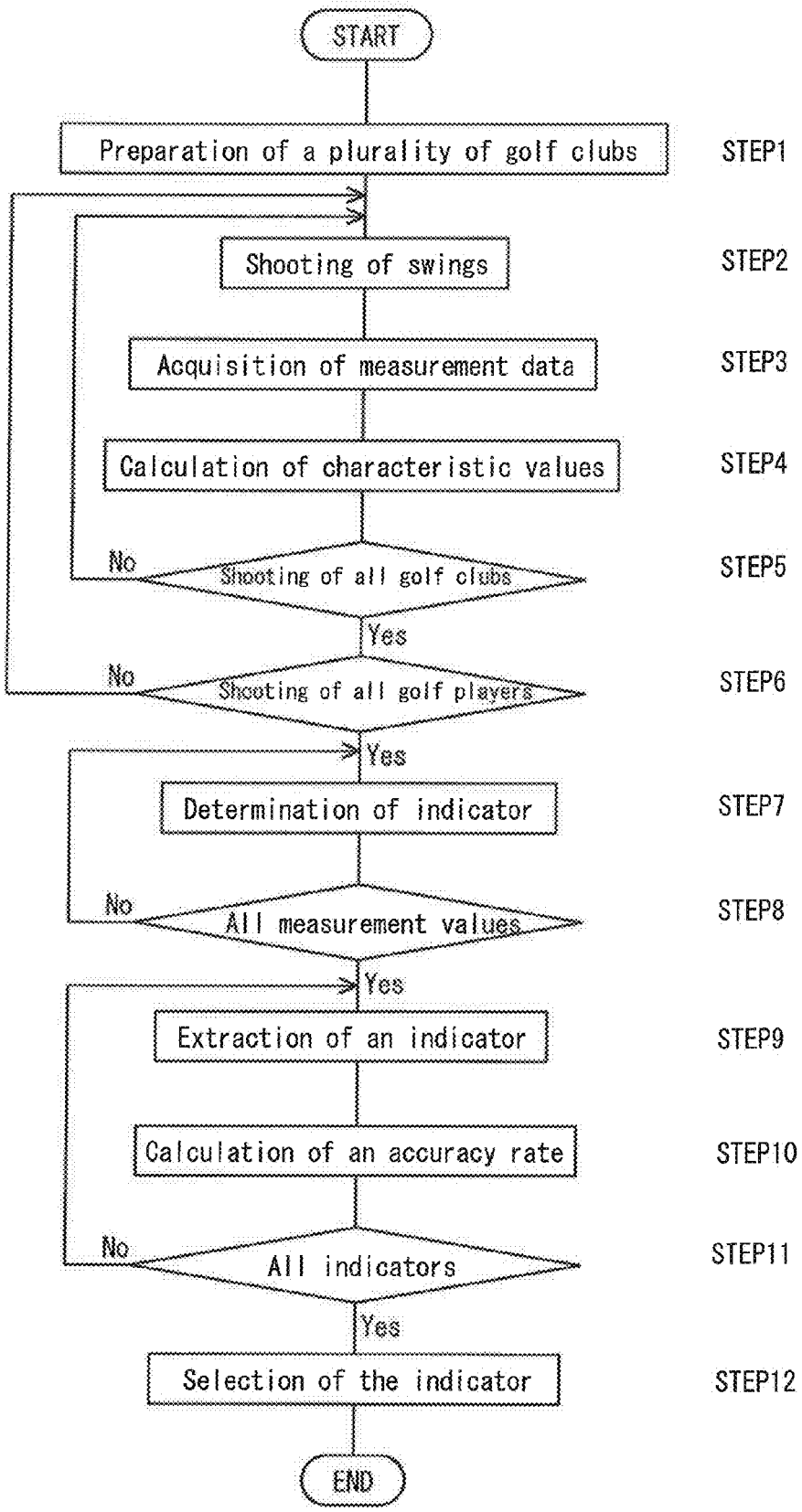
FIG. 9 is a flow chart showing other example of a method for analysis according to the present invention.

FIG. 9 shows one other example of the fitting analysis method according to the present invention. (STEP 1) to (STEP 8) of the analysis method are same as the analysis method shown in FIG. 8, and a description thereof will be omitted. Any configuration which is different from the analysis method as shown in FIG. 8 will be described.

Any one indicator is extracted from the plurality of indicators determined by (STEP 7) of the procedure as shown in FIG. 8 (STEP 9).

An accuracy rate of values of physical properties determined from the indicator is calculated (STEP 10). To be specific, for an extracted indicator, a value $Xa_{(n)}$ of a shaft physical property which fits each golf player is selected (n is a natural number corresponding to each golf player). The value $Xa_{(n)}$ of the physical property is selected based on a relational expression F1 (relational expression F11).

A value $Xb_{(n)}$ (n is a natural number corresponding to each golf player) of a shaft physical property of a golf club with the largest flight distance average is read for each golf player from stored flight distance data. For each golf player, the physical value $Xa_{(n)}$ and the physical value $Xb_{(n)}$ are compared. When the physical value $Xa_{(n)}$ and the physical value $Xb_{(n)}$ match, it is judged as a right answer. As an accuracy rate of the judgment, a rate judged as a right answer for selection result of all golf players is determined.

An accuracy rate of all of the plurality of indicators obtained in (STEP 7) is determined in a similar manner (STEP 11). An indicator with the highest accuracy rate is selected from accuracy rates of all indicators. This indicator is selected as an indicator to be used in fitting of golf club (STEP 12). In addition, in the selection of the indicator (STEP 12), a plurality of combinations of indicators are selected and a case in which one of the indicators is the indicator with the highest accuracy rate is included.

Through the use of the indicator obtained by the analysis method of FIG. 9, an accuracy rate of fitting can be improved as compared with the case where the indicator by the analysis method of FIG. 8 is used. With the analysis method, precision in fitting of a fit shaft and a combination of fit shaft and head can be improved.

Figure 10:
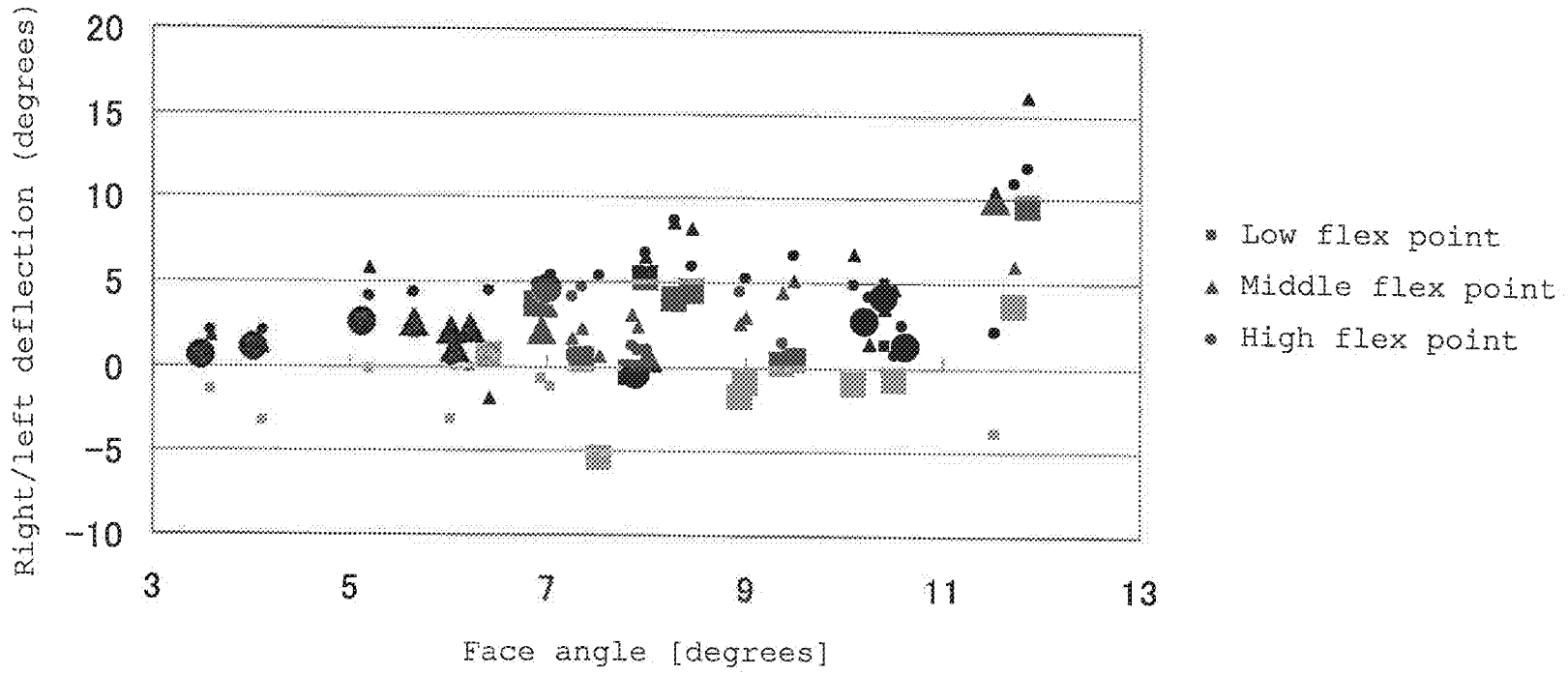
FIG. 10 is a graph showing a relation of a deflection between right or left which is a direction in which a ball flies and a face angle.

FIG. 10 shows a right/left deflection of a ball when a plurality of golf players hit balls at a club having a low flex point shaft, a club having a middle flex point shaft, and a club having a high flex point shaft. In FIG. 10, golf players are identified by a magnitude of a face angle of a test club. For each face angle, a point of a golf club with the greatest flight distance is shown bigger than points of other golf clubs. It shows a tendency that for each golf player (face angle), when the greatest flight distance is reached, a right/left deflection becomes smaller than shafts at other flex points. Golf clubs with the greatest flight distance are such distributed that a right/left deflection approaches to 0 degree.

Figure 11:
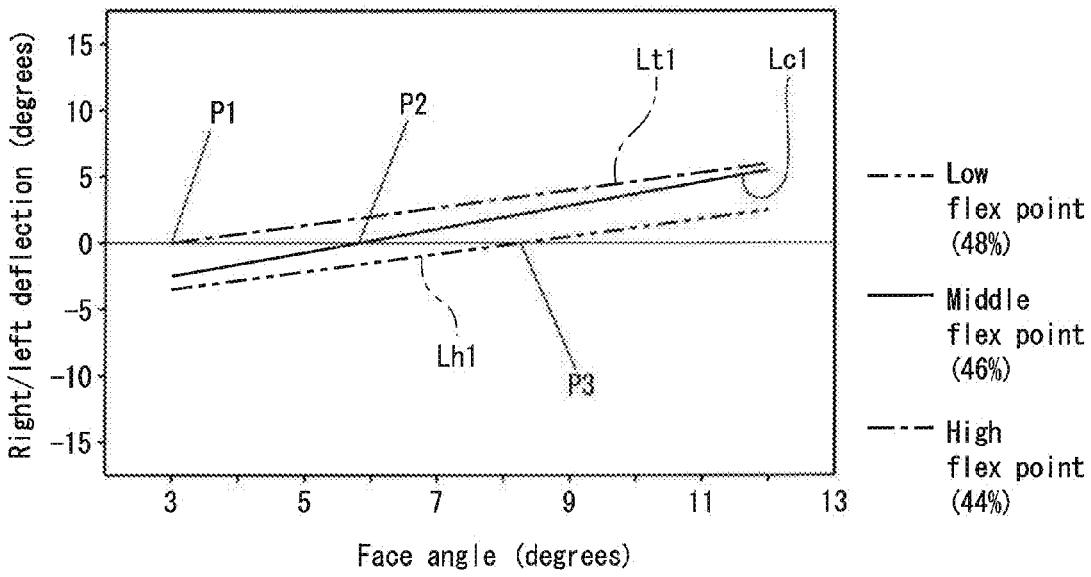
FIG. 11 is a graph showing a deflection between right and left and a face angle for each value of flex points.

FIG. 11 is determined from the data in FIG. 10. For each flex point value, a relational expression F1 (relational expression F11) of a face angle and a right/left deflection is determined. The relational expression F1 (relational expression F11) is determined by a regression analysis using the method of least squares. Based on the relational expression F1 (relational expression F11), a value of a flex point at which a right/left deflection is smallest relative to a face angle of a golf player can be determined.

Now a method for determining a straight line L1 as shown in FIG. 6 will be described. Point P1 in FIG. 6 shows a combination of a high flex point (flex point rate of 44%) and a face angle when an angle of a right/left deflection is 0 degree. Similarly, point P2 shows a combination of a middle flex point (flex point rate of 46%) and a face angle when an angle of a right/left deflection is 0 degree. Point P3 shows a combination of a low flex point (flex point rate of 48%) and a face angle when an angle of a right/left deflection is 0 degree. The straight line L1 is determined as an appropriate linear function expression which passes through the points P1, P2, and P3. Here, the straight line L1 is determined from the three points by the method of least squares.

The straight line L1 is indicated by the following appropriate linear expression where a value of a shaft flex point is Y and a value of a face angle is X. The appropriate linear expression is also an example of a relational expression F1 (relational expression F12) referred to in the present invention.

$$Y=A1\cdot X+B$$

(A coefficient A1 and an intercept B is a constant.)

A value of a flex point (flex point rate) of a fit shaft can be calculated from a face angle with the relational expression F1 (relational expression F12).

Figure 12:
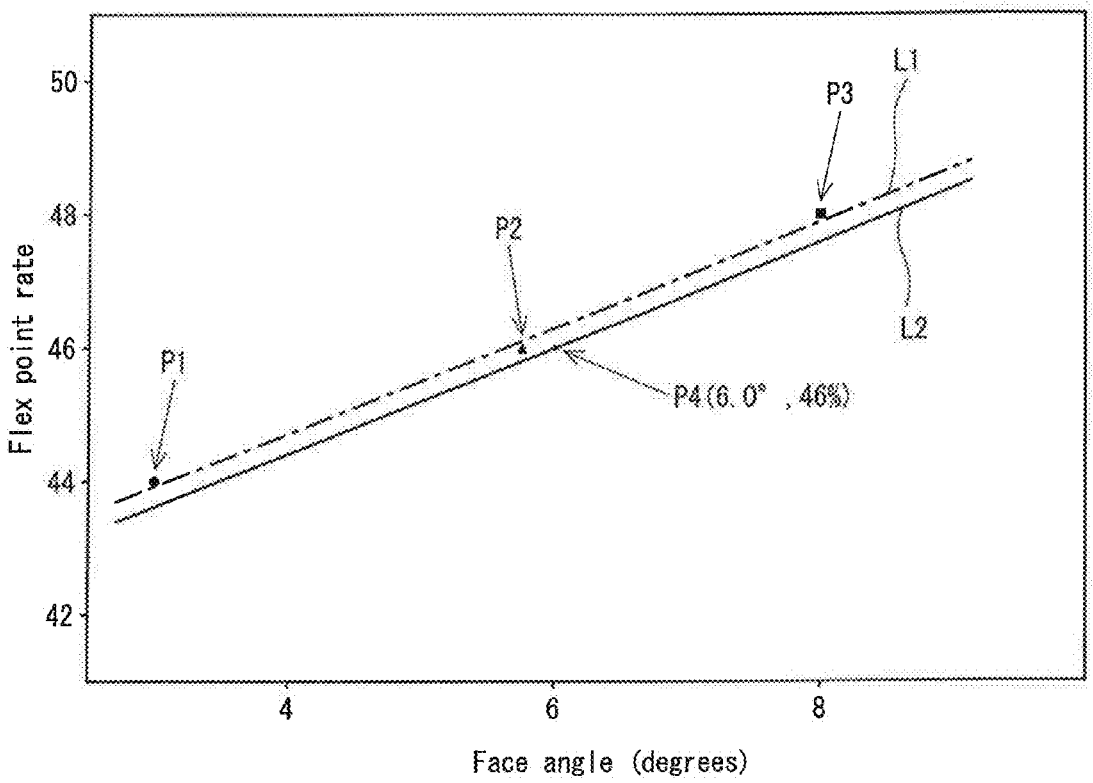
FIG. 12 is a graph showing other relation of a flex point and a face angle when a deflection between right and left is small.
Figure 13:
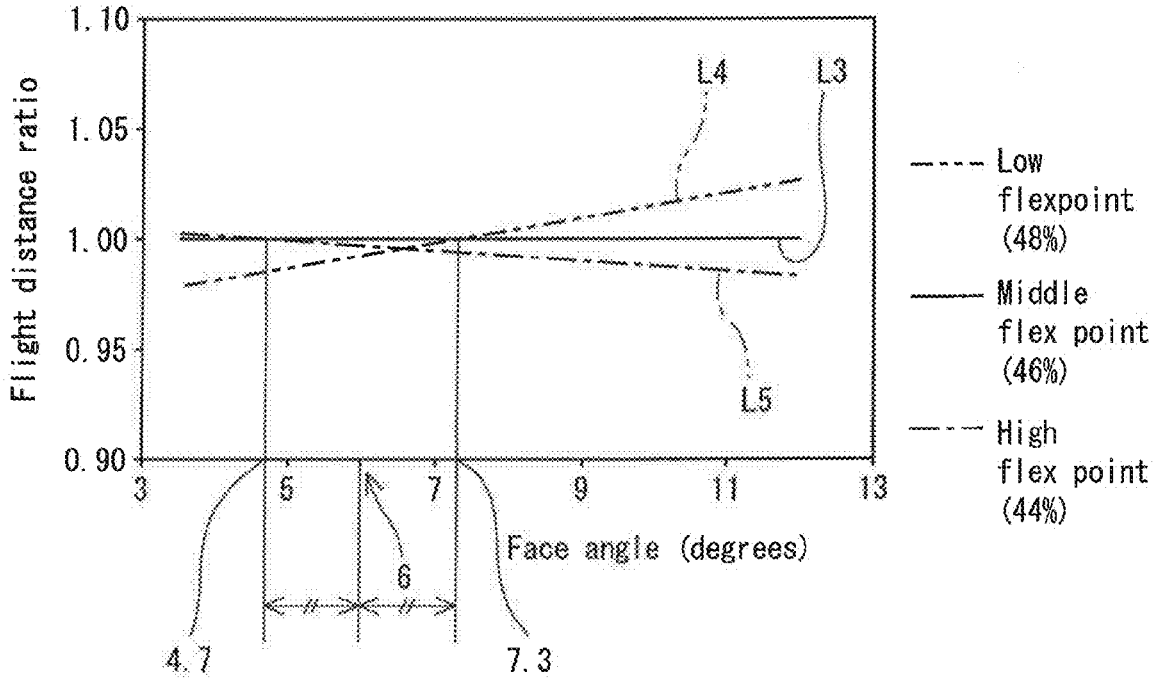
FIG. 13 is a graph showing a relation of a face angle and a flight distance ratio for each value of flex points.

Next, an analysis method according to a combination of a right/left deflection as a hitting result and a flight distance ratio is illustrated by an example. With reference to FIG. 12 and FIG. 13, a method for modifying the straight line L1, which is determined from the right/left deflection, with a relation of the flight distance ratio and the face angle will be described. In FIG. 13, a relational expression F1 (relational expression F11) of the flight distance ratio and the face angle mentioned above is determined for each value of the flex points. The relational expression F1 (relational expression F11) is determined by a multiple regression analysis with the method of least squares. Here, a face angle range which is suitable to a shaft of a middle flex point is from 4.7 degrees to 7.3 degrees. A center value of the face angle range is 6.0 degrees.

In FIG. 12, the straight line L2 is determined from the straight line L1. The straight line L2 has a same inclination A1 as the straight line L1. For the straight line L2, a value of an intercept B is modified so that it passes through point P4 of a middle flex point (flex point rate of 46%) and a face angle of 6.0 degrees. The straight line L2 may be used as the relational expression F1 (relational expression F12) in place of the straight line L1.

As described above, if the linear expression is adopted, an example of the relational expression F1 (relational expression F12) is as follows:

$$Y=A1\cdot X+B$$

Preferably, the above-mentioned relational expression F1 (relational expression F12) is a relational expression of the face angle and the shaft physical property. Preferably, the above-mentioned A1 is a positive value. Preferably, the relational expression F1 (relational expression F12) is such a relational expression that the greater the face angle X is, the lower a recommended shaft flex point is. In addition, this means that the greater the face angle X is, the more open the face angle is. For a case of a right-handed golf player, a positive face angle X means that the face is oriented to the right, and a negative face angle means that the face is oriented to the left.

In addition, the relational expression F1 (F12) is not limited to a linear expression, and may include a quadratic expression or a polynomial expression. An approximate expression is not limited to a linear expression and may include a quadratic expression or a polynomial expression.

Next, a fitting method by a combination of two types of hitting results is illustrated by an example. Use of the two types of hitting results can improve precision of fitting, compared with a case in which one type of hitting result is used. Here, as the two types of hitting results, direction and flight distance of a ball are used. In the embodiment, a right/left deflection is used as ball direction. In the embodiment, a flight distance ratio is used as flight distance. The flight distance ratio is a relative value of the flight distance. An absolute value of flight distance may also be used in place of the flight distance ratio. An absolute value of flight distance is typically displayed in yard or meter.

In the embodiment, a relational expression F12 (straight line L1) based on a first hitting result is modified on the basis of a second hitting result. The modification will be described with reference to FIG. 12 and FIG. 13, as mentioned above. Here, the right/left deflection is adopted as the first hitting result, and the flight distance ratio is adopted as the second hitting result.

First, as described above, based on the right/left deflection (first hitting result), the straight line L1 (relational expression F1; relational expression F12) is determined. Next, based on the fight distance rate (second hitting result), the straight line L1 is modified. As a result, the modified relational expression F12 is obtained. The modification is based on a relational expression F11 of the flight distance ratio and a face angle.

In the modification, flight distance at a standard shaft flex point Th is considered. The modification is such that the flight distance at the shaft flex point Th (46%) is preferred. With the modification, in addition to the first hitting result (right/left deflection), the second hitting result (flight distance) is reflected in the relational expression F12. The reflection of the two types of the hitting results can improve reliability of the relational expression F12. In the embodiment, point P4 is used in the modification.

FIG. 13 is a graph showing the relational expression F11. In FIG. 13, the relational expression F11 of the flight distance ratio and the face angle is determined for each of shaft physical property (shaft flex point rate). As the relational expression F11, three relational expressions are determined. The relational expressions F11 are determined by a regression analysis by the method of least squares, for example.

Now, a range in which a preferable result is obtained for shafts of a middle flex point is selected based on the relational expression F11 mentioned above. As shown in FIG. 13, in the embodiment, for the shaft of the middle flex point (flex point rate of 46%), the most preferable result is obtained when the face angle is in the neighborhood of 6.0 degrees. In the range of the neighborhood of 6.0 degrees, the shafts of the middle flex point have a higher flight distance ratio than shafts of a low flex point and those of a high flex point. That is to say, in FIG. 13, the straight line L3 lies in the upper side of the straight lines L4 and L5 when the face angle ranges from approximately 4.7 degrees to approximately 7.3 degrees. Any value is selected from the preferable range (from approximately 4.7 degrees to approximately 7.3 degrees). Preferably, a center value of the preferable range is selected. In the embodiment of FIG. 13, the center value is 6.0 degrees. That is to say, for the shaft with the flex point rate of 46%, flight distance is favorable when the face angle is 6.0°. Based on this result, the above-mentioned point P4 (6.0°, 46%) is determined.

In FIG. 12, the straight lines L1 to L2 are determined. The straight line L2 has a same inclination A1 as the straight line L1. In the straight line L2, a value of the intercept B is modified so that it passes through the above-mentioned point P4. Making the modification so that the straight line L2 passes through point P4 enables the favorable result of flight distance at the standard shaft flex point Th (46%) to be reflected in the relational expression F12. Therefore, the straight line L2 may be used as the relational expression F12, in place of the straight line L1. The straight line L2 is a relational expression F12 which is obtained by modifying the relational expression F12 (straight line L1) obtained based on the first hitting result (right/left deflection) on the basis of the second hitting result (flight distance ratio). In the modification, the relational expression F12 (straight line L1) is modified so that the second hitting result (flight distance ratio) in the shaft of the middle flex point is favorable. Here, the middle flex point is adopted as the standard shaft flex point Th. In addition, the standard shaft flex point Th may not be 46%.

Thus, the two types of hitting results are considered in the straight line L2. Therefore, when the expression of the straight line L2 is adopted as the relational expression F12, precision of fitting can be improved. From the standpoint of better fitting precision, three or more hitting results may be considered.

Figure 14:
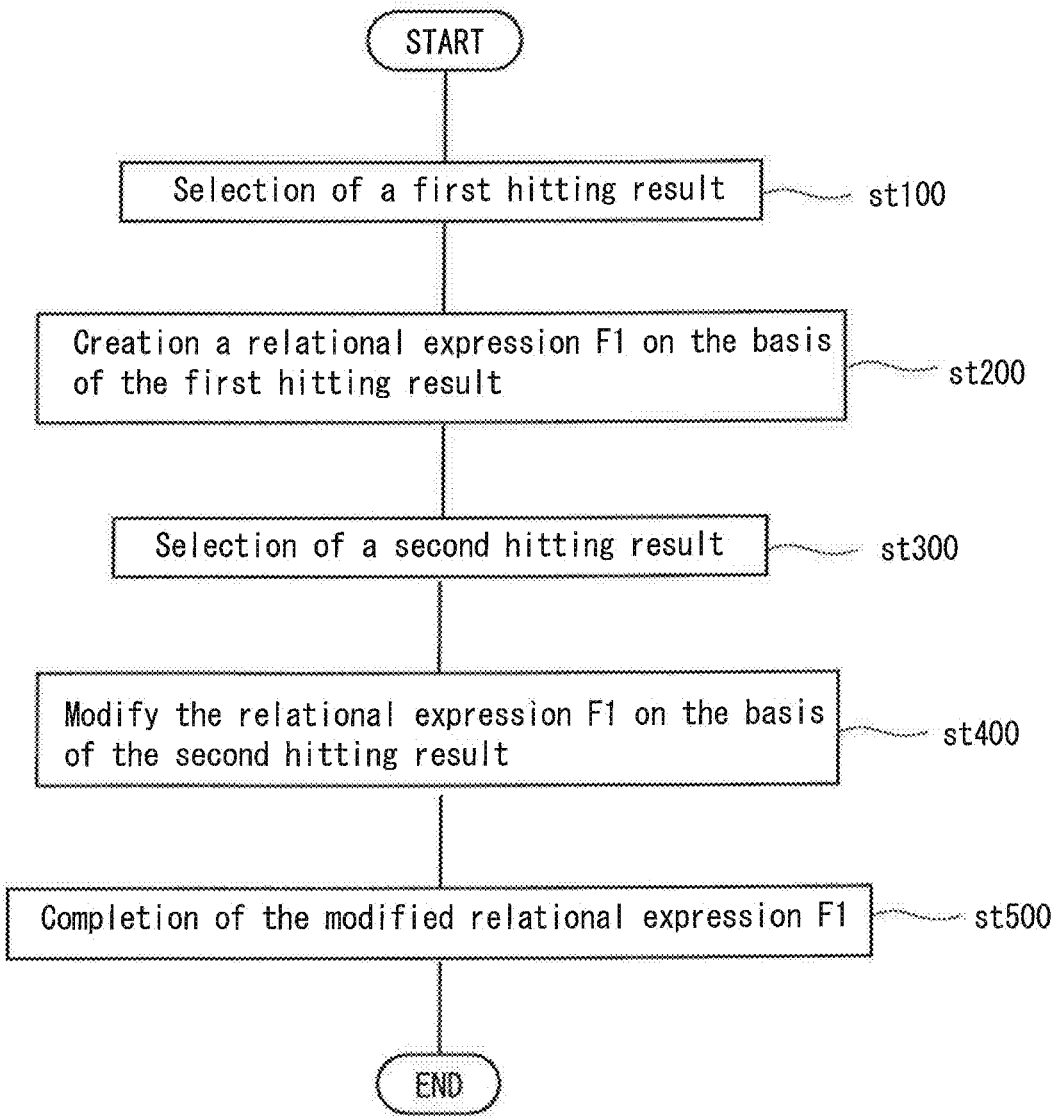
FIG. 14 is a flow chart showing one example of a method for modifying a relational expression F1 (relational expression 12) based on a first hitting result, on the basis of a second hitting result.
Figure 15:
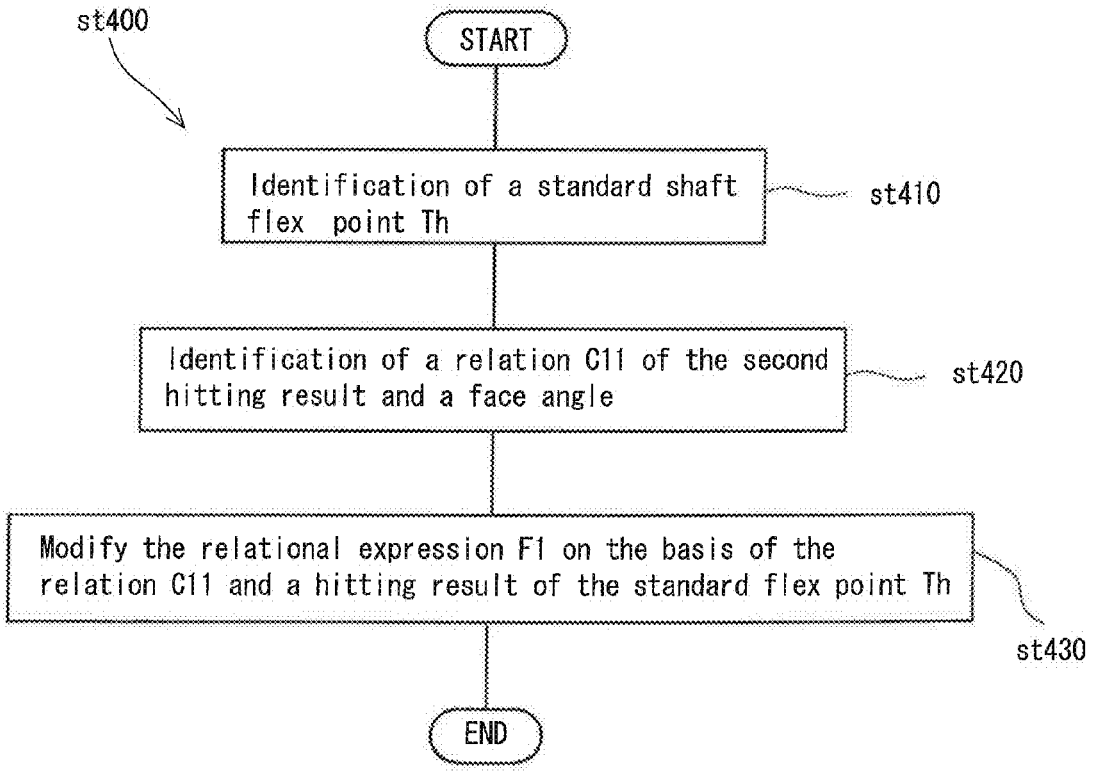
FIG. 15 is a flow chart showing one example of a method for modification based on the second hitting result.

FIG. 14 and FIG. 15 are flow charts for describing the embodiment related to FIG. 10 to FIG. 13. With reference to the flow charts, the embodiment will be described for each step.

As shown in FIG. 14, in the fitting method, the first hitting result is selected (step st100). In the embodiment, the ball direction (right/left deflection) is selected as the first hitting result.

Next, based on the first hitting result selected in step st100, a relational expression F1 (relational expression F12) is created (step st200). In the embodiment, the relational expression F1 (relational expression F12) in the step st200 is the expression of the straight line L1.

Next, the second hitting result is selected (step st300). In the embodiment, as the second hitting result, the flight distance is selected. In the embodiment, the flight distance ratio is adopted as the flight distance.

Next, based on the second hitting result (flight distance ratio), the above relational expression F1 (relational expression F12, expression of the straight line L1) is modified (step st400). In the embodiment, the modified relational expression F1 (relational expression F12) is the expression of the straight line L2. Thus, the straight line L2 as the modified relational expression F1 (relational expression F12) is complete (step st500).

FIG. 15 is a flow chart showing details of the step st400 (modification step) mentioned above. In the modification step, a standard shaft flex point Th is identified (step st410). In the embodiment, the "flex point rate of 46%" is adopted as the standard flex point Th.

Next, relation C11 of the second hitting result and the face angle is identified (step st420). In the embodiment, the relation C11 is a relational expression F11. The relational expression F11 is shown in the graph of FIG. 13.

Next, based on the relation C11 (relational expression F11), a relational expression F1 (relational expression F12) is modified (step st430). As described above, in the modification, the hitting result (second hitting result) at the standard shaft flex point Th is considered. In the embodiment, point P4 based on the relation C11 (relational expression F11) is determined, and the relational expression F12 of the straight line L1 is modified based on the point P4. With the modification, the straight line L2 is obtained.

In the step st400, at the standard shaft flex point Th (flex point rate of 46%), the relational expression F1 (relational expression F12; expression of the straight line L1) is modified so that the second hitting result is favorable. The relation C11 is used in order to reflect favorability of the second hitting result in the relational expression F1 (relational expression F12). That is to say, in the step st430, the modification is made so that the second hitting result (flight distance) is favorable at the standard shaft flex point Th.

As described above, the favorable hitting result at the standard shaft flex point Th is reflected in the relational expression F1 (relational expression F12). With the reflection, correlation of the relational expression F1 (relational expression F12) and the favorable hitting result is enhanced. Therefore, precision of fitting can be improved.

As described above, for the relational expression F12, a quadratic expression or a polynomial expression or the like can be used, in addition to a linear expression. Now, a case of a linear expression will be described.

As described above, the linear relational expression F12 is represented by the following expression 1:

$$Y=A1\cdot X+B \quad \text{(Expression 1)}$$

If a face angle X when a subject uses a test club (flex point rate of D1) is Xd1, the flex point rate Y2 recommended for the subject is determined as follows:

$$Y2=A1\cdot Xd1+B$$

Preferably, in the (Expression 1), the favorable hitting result at the standard shaft flex point Th is reflected. The reflected relational expression F1 (relational expression F12) is referred to as a relational expression F1*p* in the following. One example of the relational expression F1*p* is the expression of the straight line L2 mentioned above. It can be said that the relational expression F1*p* is a relational expression F1 (relational expression F12) which is made preferred by the standard shaft flex point Th. Therefore, the relational expression F1*p* shows favorable precision, in particular, when the shaft flex point rate D1 of the test club matches the standard shaft flex point Th.

Irrespective of a shaft flex point rate used in fitting, the relational expression F1*p* may be used. However, the relational expression F1*p* is favorable, in particular, when the shaft flex point rate D1 of the test club matches the standard shaft flex point Th. Then, it is preferable that the relational expression F1*p* is corrected based on the flex point rate of the test club used during fitting.

The corrected relational expression F1 (relational expression F12) is represented by the following Expression 2:

$$Y=A1\cdot X+B+(D1-Th) \quad \text{(Expression 2)}$$

With the corrected relational expression F1 (relational expression F12), a recommended shaft flex point can be determined with precision even if the flex point rate D1 of the test club differs from the standard shaft flex point Th.

In the relational expression F12 of the Expression 2, the measured face angle X is a first input variable, and a value (D1−Th) showing a relation of the flex point rate D1 of the test club and the standard flex point rate Th is a second input variable. In the relational expression F2 of the Expression 2, a shaft flex point rate Y which fits the subject is a result variable. With such relational expression F12, precision of fitting is enhanced irrespective of a shaft flex point rate used during fitting.

In the Expression 2, a recommended shaft flex point is determined irrespective of a flex point rate of the test club. Hence, any club can be a test club, which facilitates fitting. For example, a subject (customer) can use a club he/she likes as a test club. From this standpoint, in the preferable fitting method, the relational expression F1 (F12) does not limit a flex point rate D1 of a test club. That is to say, the preferable relational expression F1 (F12) can calculate a recommended shaft flex point rate using a test club of any flex point rate D1. An example of the preferable relational expression F1 (F12) is the Expression 2 mentioned above.

Incidentally, there is no uniform standard for shaft flex points and a plurality of standards exists. It is preferable that the standards are unified from the standpoint of fitting precision. Use of measurement results under a uniform standard enhances precision and versatility of fitting.

With the objective of enhancing versatility of fitting, a preferred fitting method further includes the step X of measuring flex point rates of more than one type of shaft under a uniform standard, and the step Y of applying the shaft flex point rate of the uniform standard to the relational expression F11 and/or the relational expression F12 and determining a recommended shaft flex point rate. In this case, the shaft flex point rate included in the relational expression F12 is the shaft flex point rate of the uniform standard. More preferably, the step X includes the step of measuring flex point rates of a plurality of shafts for which a shaft flex point is determined according to different standards, under the above uniform standard. An example of the plurality of shafts for which the shaft flex point is determined under the different standards includes shafts attached to golf clubs marketed by a plurality of golf club manufacturers. Other examples of the plurality of shafts for which the shaft flex point is determined under the different standards include shafts marketed by a plurality of shaft manufacturers. In this case, the fitting method in the embodiment is preferably applicable to shafts and golf clubs marketed by a plurality of manufacturers. Thus, for example, a golf club marketed by a plurality of manufacturers may be used as a test club. For example, a golf club possessed by a customer may be used directly as a test club.

Preferably, the uniform standard is a flex point rate to be calculated by Expression 3 to be described later.

As a relational expression F1 in this application, relational expressions F11 and F12 are illustrated by an example. Both the relational expressions F11 and F12 can be used in determining a shaft physical property which fits a subject. In a preferable relational expression F11, a face angle and a hitting result are considered. Also in a preferable relational expression F12, the face angle and the hitting result are considered.

The preferable relational expression F11 is a relational expression of a face angle and a hitting result. As an example of the preferable relational expression F11, the straight line Lt1, the straight line Lc1, and the straight line Lh1 as shown in FIG. 11 are illustrated. As an example of other relational expression F11, the straight line L3, the straight line L4, and the straight line L5 as shown in FIG. 13 are illustrated. The relational expression F11 is used in determining a shaft physical property which fits the subject. In addition, the relational expression F11 can be used as the relational expression C11.

The preferable relational expression F12 is a relational expression of a face angle and a shaft physical property. However, even in the relational expression F12, the hitting result is considered. As the relational expression F12, the Expression 1 and the Expression 2 are exemplified. An example of the Expression 1 includes the expression of straight line L1 and the expression of straight line L2. When the relational expression F12 is used, a recommended shaft physical property can be determined directly from the measured face angle. Therefore, the relational expression F12 facilitates fitting.

As shown in the embodiment described above, the relational expression F12 is created, preferably by using a plurality of relational expressions F11. By determining a relational expression F11 for each shaft physical property (shaft flex point), a plurality of relational expressions F11 is determined. Specific examples of the plurality of relational expressions F11 are the expressions of the three straight lines as shown in FIG. 11. Preferably, based on the plurality of relational expressions F11, a plurality of coordinate points for creating the relational expression F12 of the face angle and the recommended flex point rate is obtained. Examples of the coordinate points are the points P1, P2, and P3 (see FIG. 6 and FIG. 12). The coordinate points are selected so that the hitting result will be favorable. That is to say, as shown in FIG. 11, the points P1, P2, and P3 are selected so that a right/left deflection in shafts at respective flex point rates is favorable (zero). Thus, using the relational expressions F11 in creation of the relational expression F12 makes it possible to obtain the relational expression F12 in which the hitting result is considered. In the relational expression F12, a recommended shaft physical property can be obtained if a face angle (indicator) is assigned. Thus, the relational expression 12 enables fitting which has excellent convenience. In addition, since the hitting result is considered in the relational expression 12, fitting which leads to a favorable hitting result can be achieved.

On the one hand, it is also possible to perform the fitting method by using the relational expression 11, without the relational expression 12. For example, the fitting method includes the step of assigning a measured indicator (face angle) to each of the relational expressions 11 which are determined for respective shaft physical properties (shaft flex points) and calculating a hitting result for each of the shaft physical property (shaft flex point), and the step of comparing the hitting result of each shaft physical property (shaft flex point) and selecting a shaft physical property (shaft flex point) for which the hitting result is best. In the specific example of the fitting method, the measured face angles are assigned to the respective three expressions shown by the three straight lines in FIG. 13. Each of the three expressions is the relational expression F11. Then, three flight distance ratios obtained through the assignment are compared. With the comparison, the relational expression F11 showing the greatest flight distance ratio is identified. The shaft flex point rate in the identified relational expression F11 can be a recommended shaft flex point rate.

In the embodiment, the relational expression F1 (relational expression F11, relational expression F12) were used. The relation C1 (relation C11, relation C12) may be used in place of the relational expression F1. For example, the relational expression C12 may be created by using a plurality of the relations C11, which are determined for each of the shaft physical properties.

In the embodiment, the relational expression F1, the relational expression F11 and the relational expression F12 are used. However, the "relation" is not limited to the "expression". From this standpoint, the relation C1 can be used in place of the relational expression F1. In addition, the relation C11 can be used in place of the relational expression F11. In addition, the relation C12 can be used in place of the relational expression F12.

Hence, in the present invention, for example, a fitting method as described below is also possible. In the fitting method, the relation C1 contains the relation C11 and the relation C12, and the relation C12 is created by using a plurality of the relation C11 which is determined for each of the shaft physical properties.

The relation C12, which is not a relational expression, includes correspondence with a range f of face angles and a range h of shaft physical properties. In this case, when a measured face angle falls within the above range f, a shaft having a shaft physical property which falls within the range h is recommended. Preferably, a plurality of the above ranges f (for example, f1, f2, f3) are set, and a plurality of the ranges h (for example, h1, h2, h3) which correspond to respective ranges f are set. In this case, for example, when a measured face angle falls within the range f1, a shaft whose physical property falls within the range h1 is recommended, when a measured face angle falls within the range f2, a shaft whose physical property falls within the range h2 is recommended, and when a measured face angle falls within the range f3, a shaft whose physical property falls within the range h3 is recommended.

The relation C11, which is not a relational expression, includes correspondence with a range f of face angles and a range of hitting results. Preferably, the relation C11 is determined for each of physical properties of the shafts. Preferably, based on a plurality of the relations C11, the relation C12 is created. Preferably, in the creation of the relation C12, a hitting result is considered. The idea of creating the relation C12 from the relation C11 is similar to the idea of creating the relational expression F12 from the relational expression F11.

The relation C12 is a relation of the face angle and the shaft physical property. In addition to the face angle, any other element may be considered. For example, the relation C1 may be a relation of the above face angle, an incident angle, and the above shaft physical property. The relational expression F1 may be a relational expression of the face angle, an incident angle, and the shaft physical property. The incident angle shows a direction of a path of ahead before impact. An example of the incident angle includes an angle of a path of a head when viewed from the above.

From the standpoint of fitting precision, the relation C1 (the relational expression F1) is preferably created based on a large number of data pieces. From this standpoint, it is preferable that the relation C1 (the relational expression F1) has been prepared in advance before an indicator (such as a face angle or the like) is measured. However, the relation C1 (the relational expression F1) may be obtained based on the measurement result of an indicator (such as a face angle or the like).

A head may be fitted by using a shaft selected according to the present invention. An example of the head fitting method includes a method which replaces a shaft physical property in the above fitting method with a head physical property. One example of a preferable head physical property is a position of center of gravity of a head.

EXAMPLES

In the following, although the effect of the present invention will become clear by examples, the present invention should not be interpreted in a limiting way based on the description in the Examples.

Example 1

An indicator was determined by using the analyzer shown in FIG. 7 and with the analysis method shown in FIG. 8. A hitting result is flight distance. A predetermined physical property of a shaft is a flex point. Values of the physical properties is a low flex point, a middle flex point, and a high flex point.

In general, a shaft an end side of which tends to bend is referred to as a low flex point. In addition, in generally, a shaft a back end side of which tends to bend is referred to as a high flex point. Designations of the low flex point and the high flex point are known on the market as an indicator which shows a characteristic of a shaft. However, a standard of the low flex point and the high flex point is not necessarily uniform among those in the art. The actual condition is that a plurality of standards of a flex point exists.

In the embodiment, a flex point rate C1 determined with the following expression 3 is determined. A flex point whose flex point rate C1 is equal to or lower than 45% is a high flex point. A flex point whose flex point rate C1 is higher than 45% and less than 47% is a middle flex point. A flex point whose flex point rate C1 is equal to or higher than 47% is a low flex point.

$$C1=[F2/(F1+F2)]\times 100 \quad \text{(Expression 3)}$$

Here, F1 is a forward flex (mm). F2 is a backward flex (mm).

[Measurement of Forward Flex F1]

Figure 16A:
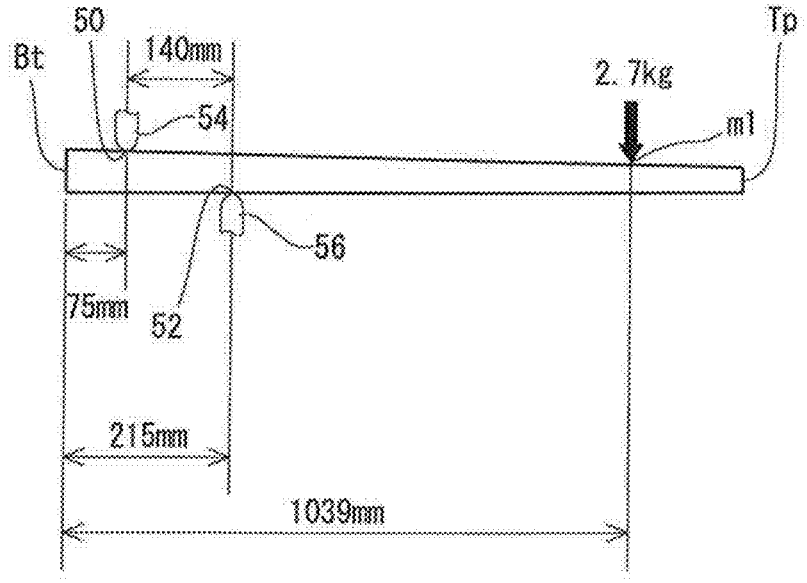
FIG. 16A is an illustration of a method for measuring forward flex.

FIG. 16A is a view for illustrating a method for measuring a forward flex F1. As shown in FIG. 16A, a first support point 50 was set at a position which is 75 mm from the shaft butt end Bt. In addition, a second support point 52 was set at a position which is 215 mm from the shaft butt end Bt. At the first support point 50, a support 54 which supports a shaft from the upper side was provided. At the second support point 52, a support 56 which supports the shaft from the lower side was provided. With no load, a shaft axis line of the shaft 20 was almost horizontal. Load of 2.7 kg was vertically acted downward on a loaded point m1 which is 1039 mm from the shaft butt end Bt. A travel distance (mm) of the loaded point m1 from when it is not loaded till when it is loaded was a forward flex F1. The travel distance is a travel distance along the vertical direction.

In addition, a cross sectional shape of a part of the support 54 which abuts the shaft (hereinafter referred to as an abutting part) is as follows. On a cross section parallel to the shaft axis line direction, a cross sectional shape of the abutting part of the support 54 has convex roundness. A curvature radius of the roundness is 15 mm. On a cross section perpendicular to the shaft axis line direction, a cross sectional shape of the abutting part of the support 54 has concave roundness. A curvature radius of the concave roundness is 40 mm. On the cross section perpendicular to the shaft axis line direction, length of the abutting part of the support 54 in the horizontal direction (length in the depth direction in FIGS. 16A and 16B) is 15 mm. A cross sectional shape of an abutting part of the support 56 is identical to that of the support 54. A cross sectional shape of an abutting part of a loading indenter (not shown) which gives load of 2.7 kg at the loaded point m1 has convex roundness on a cross section parallel to the shaft axis line direction. A curvature radius of the roundness is 10 mm. Across sectional shape of an abutting part of a loading indenter (not shown) which gives load of 2.7 kg at the loaded point m1 is a straight line on a cross section perpendicular to the shaft axis line direction. Length of the straight line is 18 mm. Thus, the forward flex F1 was measured.

[Measurement of Backward Flex F2]

Figure 16B:
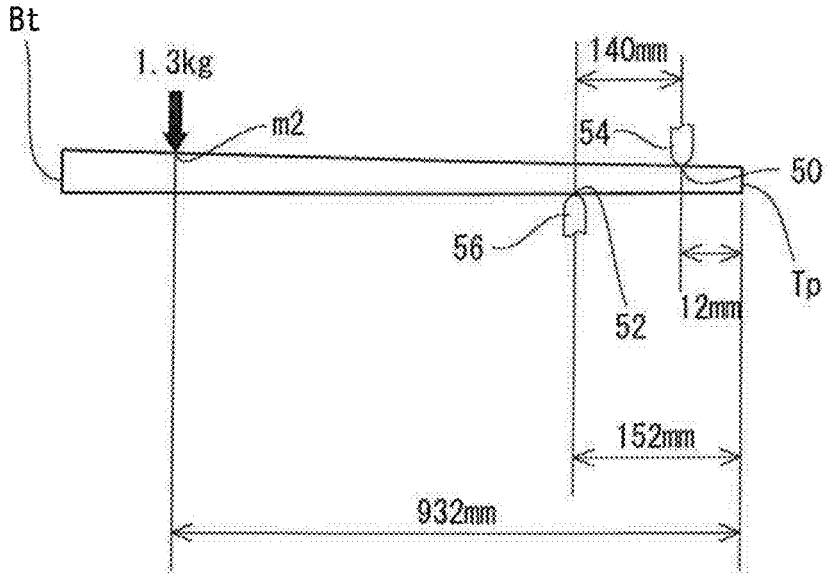
FIG. 16B is an illustration of a method for measuring backward flex.

FIG. 16B shows a method for measuring a backward flex. The backward flex F2 was measured similar to the forward flex F1, except that a first support point 50 was 12 mm away from a shaft tip end Tp, a second support point 52 was 152 mm away from the shaft tip end Tp, a loaded point m2 was 932 mm away from the shaft tip end Tp, and load was 1.3 kg.

Images of swings of 32 golf players were shot. The 32 golf players are high-level players with scores ranging from 72 to 95. The golf players hit 8 balls each with a golf club with a shaft having a low flex point, a golf club with a shaft having a middle flex point, and a golf club with a shaft having a high flex point.

Based on the measurement data, indicators were determined with the analysis method of FIG. 8. Characteristic values determined as indicators are a face angle before impact, a side spin rate of a ball, an initial-launch angle of a ball in up/down and right/left directions, a swing plane angle, a shoulder twist angle, and a swing direction travel distance.

Figure 17:
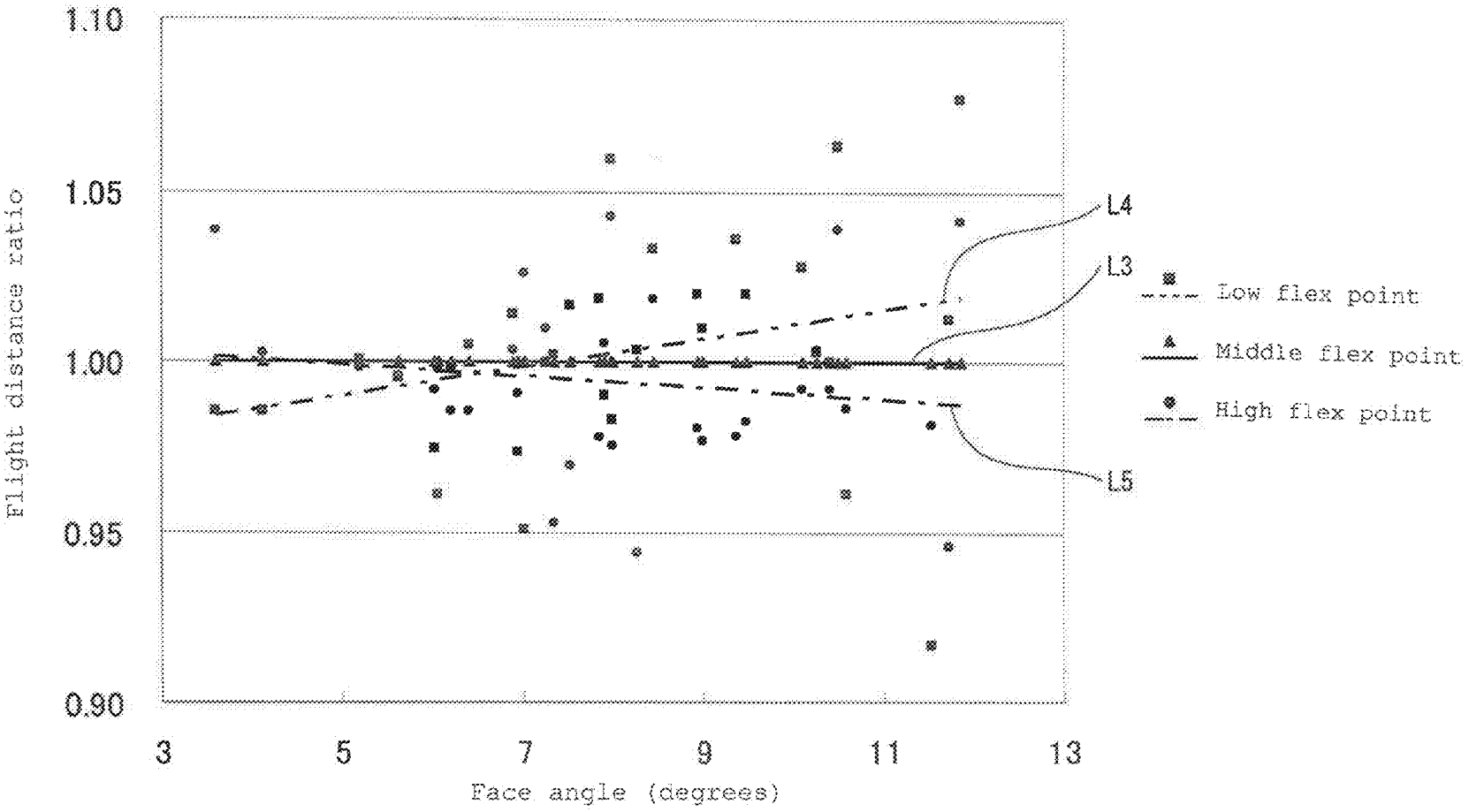
FIG. 17 is a graph showing a relation of a face angle and flight distance for each value of flex points.

FIG. 17 shows a relation of a flight distance ratio of a ball as a hitting result and a face angle before impact as an indicator, for each flex point value. Here, a face angle average of a golf club 36 (middle flex point) is a horizontal axis. The face angle is an angle when a head before impact is viewed from the above. The horizontal axis represents an average value of the face angles before impact of each golf player. The average value is obtained from measurement data of swings made by each golf player with test clubs. Here, values of shaft physical properties of the test clubs are a middle flex point.

The solid line L3 of FIG. 17 shows a linear function of the test clubs. The two-dot chain line L4 of FIG. 17 shows a linear function of the golf clubs of the low flex point. The chain line L5 of FIG. 17 shows a linear function of the golf clubs of the high flex point. The linear function of the golf clubs of the low flex point and that of the golf clubs of the high flex point are obtained by a regression analysis by the method of least squares.

In FIG. 17, for the functions determined with the low flex point and the high flex point, it is judged whether the flight distance ratio Y differs if the face angle average X differs. For example, for this linear function, it is judged whether the relational expression has an inclination. In the case where the function determined with the low flex point and the high flex point has an inclination, it can be judged that the face angle and the flight distance have a statistically significant relation when the face angle is an explanatory variable and the flight distance is an objective variable.

In the case where the inclination of the function determined with the low flex point differs from the inclination of the function determined with the high flex point, it is judged that the face angle, the flex point value, and the flight distance have a statistically significant relation when the flight distance is an objective variable, and the face angle and the shaft flex point value are explanatory variables. It is judged that the face angle and the flex point value are in an interaction relation. Thus, it is judged whether they have a statistically significant relation. For example, the judging standard is whether a product of the face angle and the shaft flex point is significant at 20% level. More preferably, the judging standard is be whether the product is significant at 10% level.

In FIG. 17, the inclination of the linear function determined with the golf club of the low flex point is 0.004163. The inclination of the linear function determined with the golf club of the high flex point is −0.001642. The inclinations are formed with respect to the function of the test clubs. When the face angle is an explanatory variable and the flight distance is an objective variable, the face angle and the flight distance have a statistically significant relation. It is judged that they have a statistically significant relation with the flight distance as an objective variable, and the face angle and the shaft flex point value as explanatory variables. It is judged that the face angle and the shaft flex point value have an interaction. An indicator whose significant difference is great highly contributes to the flight distance as a hitting result. The L3, L4, and L5 are an example of the relational expression F1.

Figure 18A:
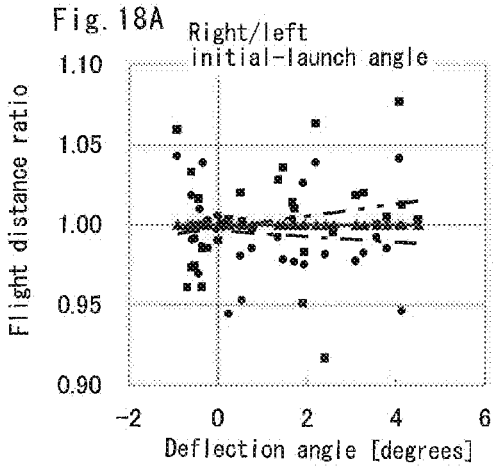
FIG. 18A to 18E are graphs showing a relation of other indicator and flight distance for each value of flex points.

FIGS. 18A to 18E show a relation of a flight distance ratio of ball flight distance as a hitting result and a characteristic value as an indicator. The graphs of FIG. 18A to 18E are determined in a similar manner to FIG. 17 described above. An indicator of FIG. 18A is an initial-launch angle of a ball. An initial-launch angle of a ball has an up/down direction and a right/left direction. FIG. 18A shows an initial-launch angle in the right/left direction and referred to as a right/left initial-launch angle. The right/left initial-launch angle is an angle in the right/left direction in which a ball flies. The right/left initial-launch angle is measured between impact and the time 30 msec after impact.

Figure 18B:
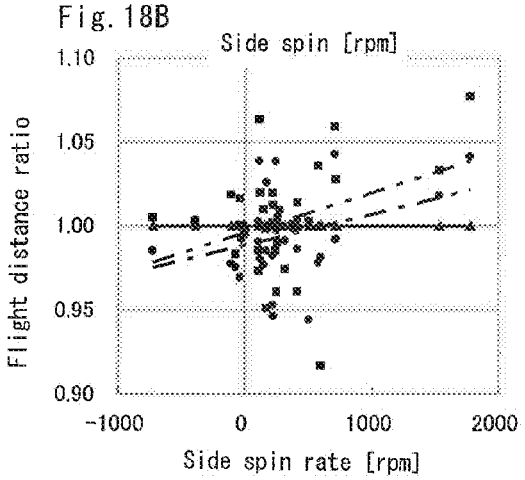

An indicator of FIG. 18B is a spin rate. The spin rate has a back direction and a side direction. FIG. 18B is a spin rate in the side direction and referred to as a side spin rate. The side spin rate is an amount of rotation in the side direction for 30 msec after impact. Here, the unit rpm is used.

Figure 18C:
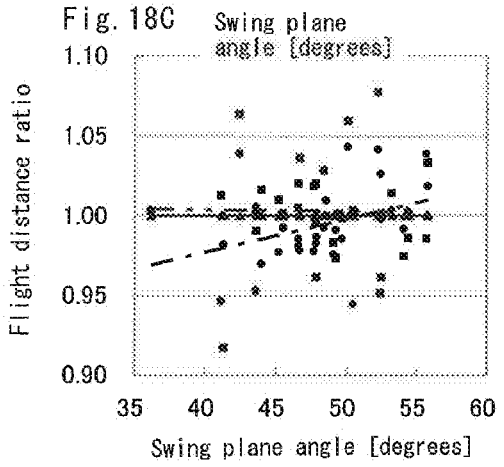

An indicator of FIG. 18C is a swing plane angle. A swing plane angle is an angle of a shaft axis line to the ground. The swing plane angle is measured from the front or the back of a golf player. For example, when a golf player swings a golf club, a shaft before impact is shot from the back of the golf player. The angle of the shaft axis line to the ground is the swing plane angle.

Figure 18D:
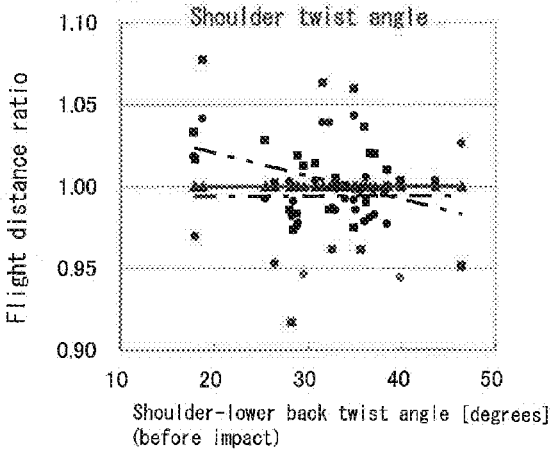

An indicator of FIG. 18D is a shoulder twist angle. A shoulder twist angle is a twist angle of the shoulder with respect to the lower back. The shoulder twist angle is measured from a golf player's profile before impact. For the shoulder twist angle, markers are attached to both right and left shoulders and both lower backs, for example. The markers are shot from above the golf player. In a planar view, an angle of a straight line passing through the markers of both shoulders to a straight line passing through the markers of both lower backs is a shoulder twist angle.

Figure 18E:
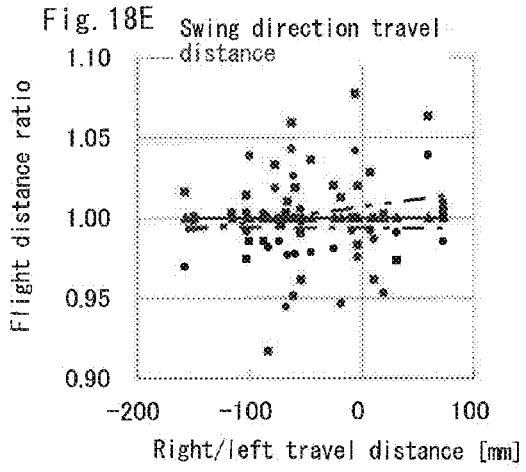

An indicator of FIG. 18E is a swing direction travel distance. A swing direction travel distance is travel distance of a golf player in a front/back direction. For the swing direction travel distance, travel distance from an address to an impact is measured. Travel distance of a body axis (centerline in the right/left direction) of the golf player is measured. For the swing direction travel distance, for example, markers attached to the golf player are shot from the front face of the golf player. The body centerline is determined. The travel distance in the swing direction from the address to the impact is calculated.

The face angle, the right/left initial-launch angle, the side spin rate, the swing plane angle, the shoulder twist angle, and the swing direction travel distance are determined as indicators.

Example 2

For the face angle, the right/left initial-launch angle, the side spin rate, the swing plane angle, the shoulder twist angle, and the swing direction travel distance, an accuracy rate of (STEP 10) of FIG. 9 was further calculated. Table 1 shows results.

TABLE 1

| Evaluation result | |
|---|---|
| Indicators | Accuracy Rate (%) |
| Face angle | 72 |
| Shoulder twist angle | 63 |
| Right/left Initial-launch angle | 59 |
| Swing plane angle | 53 |
| Swing direction travel distance | 53 |
| Side spin | 53 |

Of the indicators in Table 1, the indicator with the highest accuracy rate was the face angle. The face angle is determined as the indicator.

In the Examples 1 and 2, the golf club is fitted from the three types of golf clubs with different shaft flex points. At any indicator, the accuracy rate of 50% or higher is obtained. In addition, in the fitting with the shoulder twist angle as the indicator, the accuracy rate of 60% or higher is obtained. In the fitting with the face angle as the indicator, the accuracy rate of 70% or higher is obtained. The effect of the present invention is obvious from the Table 1.

In this manner, it was found that the face angle is preferred as an indicator. For this reason, the Claims of the present invention include those with the face angle specified as the indicator. However, using the face angle as the indicator is simply one example of the present invention. Any data that can be measured can be used as an indicator. In all claims of the present application, a "face angle" may be replaced with an "indicator". Thus, for example, the fitting method according to the resent invention may be a golf club fitting method, comprising steps of: preparing a relation C1 which considers an indicator before or at ball impact and a hitting result when a plurality of golf players makes swings using a plurality of golf clubs with different values of shaft physical properties; obtaining a measurement result of the indicator by a subject (golf player) hitting a ball with a test club; and determining a shaft physical property which fits the subject on the basis of the relation C1 and the measurement result of the indicator The above description is just an example, and various changes can be made without departing from the scope of the present invention.

What is claimed is:

1. A golf club fitting method, comprising steps of:

preparing, by a processor, a relation C1 in which a face angle before or at ball impact and a hitting result are considered, wherein the face angle and the hitting result are measured when a plurality of golf players makes swings using a plurality of golf clubs with different values of shaft physical properties;

obtaining, by the processor, a measurement result of the face angle by a subject (golf player) hitting a ball with a test club; and determining a shaft physical property which fits the subject on the basis of the relation C1 and the measurement result of the face angle.

2. The fitting method according to claim 1, wherein the relation C1 is a relational expression F1.

3. The fitting method according to claim 2, wherein when a relational expression of the hitting result and the face angle is F11 and a relational expression of the face angle and the shaft physical properties is F12, the relational expression F1 is the relational expression F12 created by using the relational expression F11.

4. The fitting method according to claim 3, wherein the relational expression F12 is such a relational expression that the greater the measured face angle is, the lower a recommended shaft flex point is.

5. The fitting method according to claim 3, wherein a preferable hitting result at a standard shaft flex point Th is reflected in the relational expression F12.

6. The fitting method according to claim 3, wherein two or more types of hitting results are considered in the relational expression F12.

7. The fitting method according to claim 6, wherein the relational expression F12 is created by modifying a relational expression based on a first hitting result, on the basis of a second hitting result.

8. The fitting method according to claim 7, wherein the modification based on the second hitting result is such a modification that the second hitting result is preferable at the standard shaft flex point Th.

9. The fitting method according to claim 7, wherein the first hitting result is a direction of a hit ball, and the second hitting result is flight distance.

10. The fitting method according to claim 3, wherein in the relational expression F12, the measured face angle is a first input variable;

a value showing a relation of a shaft flex point rate of the test club and the standard shaft flex point Th is a second input variable; and the shaft flex point rate which fits the subject is a result variable.

11. The fitting method according to claim 1, wherein the shaft physical property is a shaft flex point.

12. The fitting method according to claim 3, wherein the relational expression F11 and/or the relational expression F12 is a linear expression.

13. The fitting method according to claim 3, wherein the hitting result in the relational expression F11 is a right/left direction in which a ball flies.

14. A golf club fitting method, comprising steps of:

acquiring, by a processor, measurement data and hitting results of a plurality of golf players using a plurality of golf clubs with different values of shaft physical properties;

obtaining, by the processor, characteristic values on the basis of the measurement data;

determining, by the processor, an indicator for selecting a shaft of a golf club from the characteristic values and the hitting results;

obtaining, by the processor, a relational expression F1 of the indicator and the hitting result for each value of the shaft physical properties;

obtaining, by the processor, a measurement result corresponding to the indicator by a subject (golf player) hitting a ball with a test club; and determining a shaft physical property which fits the subject on the basis of the relational expression F1 and the measurement result, wherein in the step of acquiring the multiple measurement data pieces and the hitting results, multiple measurement data pieces are obtained from swings of the golf player and hitting of the swings, and wherein in the step of determining the indicator, the characteristic value is determined as the indicator when the hitting result is an objective variable, the characteristic value and the value of the shaft physical property are explanatory variables, and the characteristic value has a statistically significant relation with the hitting result.

15. The fitting method according to claim 14, wherein in the step of determining an indicator, a plurality of indicators is determined, the method further comprising steps of:

calculating an accuracy rate of values of shaft physical properties determined from the plurality of indicators; and selecting an indicator used in fitting of a golf club on the basis of the accuracy rate, wherein in the step of calculating the accuracy rate of values of shaft physical properties, a value Xa of a fit shaft is selected based on a relational expression F1 of the indicator and the hitting result;

a value Xb of a fit shaft is determined based on a value of a hitting result to be obtained from the swings; and a golf player rate for which the value Xa and the value Xb match is calculated, and the rate is an accuracy rate, wherein in the step of selecting an indicator used in fitting of a golf club, an indicator with the highest accuracy rate is selected as the indicator used in fitting.

16. The fitting method according to claim 14, wherein the hitting result is flight distance of a ball;

the shaft physical property is a shaft flex point; and the characteristic value is a face angle before or at ball impact.

17. The fitting method according to claim 14, wherein the hitting result is a right/left direction in which a ball flies;

the shaft physical property is a shaft flex point; and the characteristic value is a face angle before or at ball impact.

18. The fitting method according to claim 17, wherein a value X of a face angle at which an absolute value of a direction in which a ball flies is 0 is determined, for each value Y of the shaft flex point;

an approximate expression $$Y=A1\cdot X+B$$

(A coefficient A1 and an intercept B are n constant) which satisfies each relation of the value Y of the flex point of the plurality of shafts and the value X of the face angle is determined; and the approximate expression is the relational expression F1.

19. The fitting method according to claim 18, wherein the intercept B is modified based on a relation of flight distance of a ball and a value of a face angle.

20. A method for analyzing swings of a golf club, comprising steps of:

performing the following steps by a processor;

acquiring measurement data and hitting results of a plurality of golf players using a plurality of golf clubs with different values of shaft physical properties;

obtaining characteristic values on the basis of the measurement data;

determining an indicator for selecting a shaft of a golf club from the characteristic values and the hitting results; and obtaining a relational expression F1 of the indicator and the hitting results for each value of the shaft physical properties, wherein in the step of acquiring the multiple measurement data pieces and hitting results, multiple measurement data pieces are obtained from swings of golf players and hitting of the swings, and wherein in the step of determining the indicator the characteristic value is determined as the indicator, when the hitting result is an objective variable, the characteristic value and the value of the shaft physical property are explanatory variables, and the characteristic value has a statistically significant relation with the hitting result.

21. The method for analyzing according to claim 20, wherein in the step of determining the indicator, a plurality of indicators is determined, the method comprising steps of:

calculating accuracy rates of values of shaft physical properties determined from the plurality of indicators; and selecting an indicator used in fitting of a golf club, wherein in the step of calculating accuracy rates of values of shaft physical properties, a value Xa of a fit shaft is selected based on a relational expression F1 of the indicator and the hitting result;

a value Xb of a fit shaft is determined based on a value of a hitting result to be obtained from the swings; and a golf player rate for which the value Xa and the value Xb match is calculated, and the rate is the accuracy rate, wherein in the step of selecting an indicator used in fitting of a golf club, an indicator with the highest accuracy rate is selected as the indicator used in fitting.

22. The method for analyzing according to claim 20, wherein the hitting result is flight distance of a ball;

the shaft physical property is a shaft flex point; and the characteristic value is a face angle before or at ball impact.

23. The method for analyzing according to claim 20, wherein the hitting result is a right/left direction in which a ball flies;

the shaft physical property is a shaft flex point; and the characteristic value is a face angle before or at ball impact.

* * * * *